US010925795B1

(12) United States Patent
Goldberg

(10) Patent No.: US 10,925,795 B1
(45) Date of Patent: Feb. 23, 2021

(54) STRETCHING DEVICES

(71) Applicant: Serge Goldberg, Ambler, PA (US)

(72) Inventor: Serge Goldberg, Ambler, PA (US)

( * ) Notice: Subject to any disclaimer, the term of this patent is extended or adjusted under 35 U.S.C. 154(b) by 0 days.

(21) Appl. No.: 17/021,590

(22) Filed: Sep. 15, 2020

Related U.S. Application Data

(63) Continuation of application No. 16/856,690, filed on Apr. 23, 2020, now Pat. No. 10,849,813.

(51) Int. Cl.

| | |
|---|---|
| ***A61H 1/02*** | (2006.01) |
| ***A63B 23/035*** | (2006.01) |
| ***A63B 23/04*** | (2006.01) |
| *A63B 23/00* | (2006.01) |

(52) U.S. Cl.
CPC ..... *A61H 1/0237* (2013.01); *A63B 23/03508* (2013.01); *A63B 23/0482* (2013.01); *A63B 2023/006* (2013.01); *A63B 2208/0204* (2013.01); *A63B 2208/0209* (2013.01)

(58) Field of Classification Search
CPC ..... A61H 1/0237; A63B 23/03508; A63B 23/0482; A63B 2023/006; A63B 2208/0204; A63B 2208/0209
See application file for complete search history.

(56) References Cited

U.S. PATENT DOCUMENTS 4,784,121 A * 11/1988 Brooks ..... A61H 1/0237 482/131
4,844,454 A * 7/1989 Rogers ..... A61H 1/024 482/131
4,892,304 A * 1/1990 DeNiro ..... A63B 23/0488 482/907
5,122,106 A * 6/1992 Atwood ..... A61H 1/0244 482/131
5,558,607 A * 9/1996 Darling ..... A63B 23/0488 482/907
7,762,936 B2 * 7/2010 Conley ..... A61H 1/0244 482/131
7,841,973 B2 * 11/2010 Trancart ..... A61H 1/0237 482/131
9,566,470 B2 * 2/2017 Malizia ..... A61H 1/024
10,518,129 B2 * 12/2019 Raiten ..... A63B 23/0482
2008/0182730 A1 * 7/2008 Conley ..... A61H 1/0244 482/95
2013/0225378 A1 * 8/2013 Burek ..... A63B 23/0216 482/142
2016/0354627 A1 * 12/2016 Cygan ..... A63B 24/0087

* cited by examiner

*Primary Examiner* — Joshua Lee
(74) *Attorney, Agent, or Firm* — Caesar Rivise, PC

(57) ABSTRACT

A device for stretching either the quadriceps or hamstring muscles of an individual's legs while the individual is in a standing position. The device includes a frame assembly and a rotational mount connected thereto. A stretching member is rotationally mounted on the rotational mount intermediate its ends to provide a first section extending on one side of the rotational mount and a second section extending on a second side of the rotational mount. The stretching member includes a foot support adjacent a distal end of the first section spaced from the rotational mount and a gripping member adjacent a distal end of the second section spaced from the rotational mount. The gripping member is engageable by an individual in a standing position to apply a rotational force to the stretching member with the individual's foot on the foot support to stretch either the quadriceps or hamstring muscles of the individual's legs.

24 Claims, 23 Drawing Sheets

STRETCHING DEVICES

RELATED APPLICATIONS

This application is a continuation of application Ser. No. 16/856,690, filed on Apr. 23, 2020, and titled STRETCHING DEVICES, which was allowed on Aug. 12, 2020.

BACKGROUND OF THE INVENTION

Field of the Invention

This invention relates generally to stretching devices and more particularly to stretching devices for stretching the quadriceps and hamstring muscles, respectively.

Description of Related Art

Precor Incorporated (Precor) markets a device identified as a "stretch trainer" that is intended for use in stretching a number of different areas of the body, including the quadriceps and hamstring muscles. To stretch the quadriceps an individual supports the leg to be stretched on a pivotal support member by bending the leg backwards, and then relative movement to stretch that leg is provided by the individual bending the other leg while it is supported on the ground. The support member for the leg to be stretched is not designed to be moved to provide the stretching action and the bending of the other leg may be difficult for the individual; particularly if that leg is not strong. To stretch the hamstring muscles an individual leans back on a pivotally mounted supporting seat member and raises the leg to be stretched forwardly about the hip joint to rest the leg on a supporting arm or rail. It can be difficult and uncomfortable for the individual to place the leg to be stretched on the supporting arm or rail.

To stretch either the quadriceps or hamstring muscles employing the Precor stretch trainer the individual must move his or her body either up or down; the support for the leg to be stretched being non-movable during the stretching operation.

Other devices are employed to strengthen the quadriceps and hamstring muscles but do not provide the desired range of movement to most effectively stretch those muscles. For example, Precor sells a leg curl device that employs a weight stack to permit adjustment of the force an individual needs to apply to curl his/her leg(s) from an essentially straight condition to a bent condition while in a seated position and with the lower end of the leg supported on a roller. In this curl exercise the individual cannot bend his/her leg(s) backward to a position either close to or touching the buttocks, which is a range of motion that is highly desirable to effectively stretch the quadriceps.

Precor also sells a leg extension device that employs a weight stack to permit adjustment of the force an individual needs to apply against a leg support to extend his/her leg(s) upwardly from a bent condition to a straight condition while in a seated position. This extension is provided by rotation of the leg about the knee; whereas most effective stretching of the hamstring muscles requires the stretching of the leg(s) to be stretched about the individual's hip.

Other devices have been suggested for use by an individual for stretching the hamstring muscles and quadriceps either in a seated position or lying down. To the best of applicant's knowledge an effective and easy to use hamstring stretching device and quadriceps stretching device has not been designed for stretching those muscles while an individual is in a standing position.

For example, individuals have employed angularly adjustable sit-up benches to carry out either a hamstring or quadriceps stretching operation while the individual is in a standing position. However those benches were not designed for that purpose and generally are not comfortable to use; nor do they permit an individual to balance himself or herself during the stretching operation. Specifically, an end of the bench that is adapted to be raised or lowered includes feet-engaging members for engaging the feet of an individual doing sit-ups and preventing the individual from sliding off the other end of the bench opposite the feet-engaging members. A individual desiring to use this device to stretch either the hamstring muscles or quadriceps stands at the end of the bench that includes the feet-engaging members; angularly adjusts the bench and then puts a leg to be stretched on an upper surface of one of the feet-engaging members. A stretching operation can then be carried out by the individual bending his/her other leg to lower the torso of the body relative to the leg to be stretched. The feet-engaging members are not moved during this stretching operation. This is an awkward and uncomfortable movement; including, among other deficiencies, no support for the individual carrying out the stretching operation.

Applicant is not aware of any devices for permitting the comfortable, manually-actuated stretching of either the quadriceps or hamstring muscles of an individual while the individual is in a standing position. The present inventions relate to such devices.

SUMMARY OF THE INVENTIONS

This application is directed to separate devices for stretching the quadriceps and hamstring muscles, respectively. Both devices include common or generic features that are submitted to be patentably novel, and also patentably novel features that differ from each other.

Both devices are employed by an individual in a standing position and in accordance with broad features of the invention both devices include the following features:

a frame assembly;

a rotational mount connected to the frame assembly;

a stretching member rotationally mounted on the rotational mount intermediate ends of the stretching member to provide a first section extending on one side of the rotational mount and a second section extending on a second side of the rotational mount opposite the first side; a foot support adjacent a distal end of the first section spaced from the rotational mount and a gripping member adjacent a distal end of the second section spaced from the rotational mount, said gripping member being configured to be gripped by a hand of an individual desiring to apply a rotational force to the stretching member about the rotational mount when the individual is in a standing position and with a foot of the individual being on the foot support, whereby the individual can apply a manual, rotational force to the stretching member to thereby stretch either the quadriceps or hamstring muscles of the individual's legs depending upon on whether the individual has his/her back to the foot support or is facing the foot support, respectively.

Preferably, in both stretching devices the gripping member of the stretching member is mounted for linear movement to permit adjustment of the gripping location by the individual engaged in the stretching operation.

In a preferred embodiment, the rotational mount for each device is vertically adjustable relative to a surface on which individual being stretched is standing. However, the purpose of providing the vertical adjustment is different for each of the devices.

In the device for stretching the quadriceps, with the individual's leg bent rearward for engaging the foot support of the stretching member, the vertical adjustment is provided to permit the axis of rotation of a rotational mount to be placed in substantial alignment with the knee to be stretched while the stretching member is rotated in an arcuate path to stretch the individual's quadriceps.

In the device for stretching the hamstring muscles by keeping the leg forward and straight to engage the foot support of the stretching member, the vertical adjustment is provided to adjust the vertical position or location of arcuate movement of the stretching member when the individual engages the gripping member of the stretching member and rotates the stretching member through an arcuate path to stretch the individual's hamstring muscles.

In the preferred embodiment of the quadriceps stretching device, the first section of the stretching member includes one or more linearly adjustable segments for accommodating different lengths of the lower foot section between the knee and foot of the individual using the device.

In the preferred embodiment of the hamstring stretching device the first section of the stretching member preferably is of a fixed, non-adjustable length but can include one or more linearly adjustable segments if desired. The adjustability of the first section is not required because an individual can position himself either closer or farther from the foot support to provide the proper location of the foot to be stretched on the foot support.

In both the quadriceps stretching device and the hamstring stretching device the gripping member preferably is adjustable to provide for the comfortable engagement of the stretching member by individuals of different heights. However, in accordance with the broadest aspects of the invention the gripping member is not required to be adjustable.

In one embodiment of the invention, preferably employed in the quadriceps stretching device, the rotational mount is vertically adjustable in a linear direction. This preferably is achieved by connecting the rotational mount to a member movable on the frame assembly in a linear, vertical direction.

In another embodiment of the invention, preferably employed in the device for stretching an individual's hamstring muscles, the rotational mount is vertically adjustable through an arcuate path including a vertical component of motion. This preferably is achieved by connecting the rotational mount to a member that itself is rotationally movable on the frame assembly in an arcuate path.

In accordance with the broadest aspects of this invention, either of the above-identified arrangements for providing vertical adjustability of the rotational mount can be employed in either the quadriceps stretching device or the device for stretching the hamstring muscles.

In fact, in accordance with the broadest aspects of this invention any suitable arrangement can be employed to provide for the vertical adjustability of the rotational mount in both stretching devices of this invention, provided that the arrangement does not interfere with the desired operation of the devices. The specific arrangement for providing vertical adjustability of the rotational mount does not constitute a limitation on the broadest aspects of this invention.

In accordance with preferred embodiments of this invention the foot support of each stretching device is configured to receive and support either foot of an individual; without requiring the individual to reposition his/her feet relative to the stretching device.

In the most preferred embodiments of the quadriceps and hamstring muscles stretching devices the frame assembly includes a hand support configured to be engaged by the individual's hand that is not employed to grip the gripping member when the individual is using the device, the hand support being laterally spaced from the stretching member to provide a space between the hand support and stretching member to accommodate the individual in a region between the hand support and stretching member during the stretching operation.

In the most preferred embodiments of the quadriceps and hamstring muscles stretching devices a clutch is provided that normally is engaged for preventing rotation of the stretching member about its rotational mount; the clutch including a manually actuatable member for disengaging the clutch to permit manual rotation of the stretching member about its rotational mount to provide the desired quadriceps or hamstring muscles stretching devices.

In accordance with the broadest aspects of this invention any type of clutch mechanism can be employed; the specific clutch mechanism not constituting a limitation on the broadest aspects of this invention. For example, the clutch mechanism can be manually, electrically or pneumatically operated. Most preferably the clutch mechanism is actuated from the gripping member when engaged by the exerciser, to be disengaged to permit rotation of the stretching member about the rotational mount to provide the desired stretching function.

BRIEF DESCRIPTION OF THE DRAWINGS

The invention will be described in conjunction with the following drawings in which like reference numerals designate like elements and wherein:

FIGS. 8-14 show a device in accordance with this invention for stretching the quadriceps of an individual.

FIG. 8 is an isometric view of a device in accordance with this invention for stretching the quadriceps of an individual with the rotational mount of the stretching member in its lowermost vertical rotational position;

FIG. 9 is an isometric view similar to FIG. 8, but with the rotational mount for the stretching member in a vertical position higher than that shown in FIG. 8, and with segments of the first section of the stretching member being adjusted to increase the length of the first section relative to its length shown in FIG. 8;

FIG. 10, is an isometric view similar to FIGS. 8 and 9, but with the rotational mount for the stretching member in its highest vertical position and with segments of the first section of the stretching member being adjusted to increase the length of the first section relative to its length shown in FIGS. 8 and 9;

FIG. 11 is a sectional view along line 11-11 of FIG. 10 showing details of the clutch mechanism in its normally engaged condition; said clutch mechanism being the same as shown in FIGS. 4B and 4C and employing the clutch circuitry shown in FIG. 4A.

DETAILED DESCRIPTION

All references cited herein are hereby incorporated by reference in their entireties. In the event of a conflict in a definition in the present disclosure and that of a cited reference, the present disclosure controls.

Figure 1:
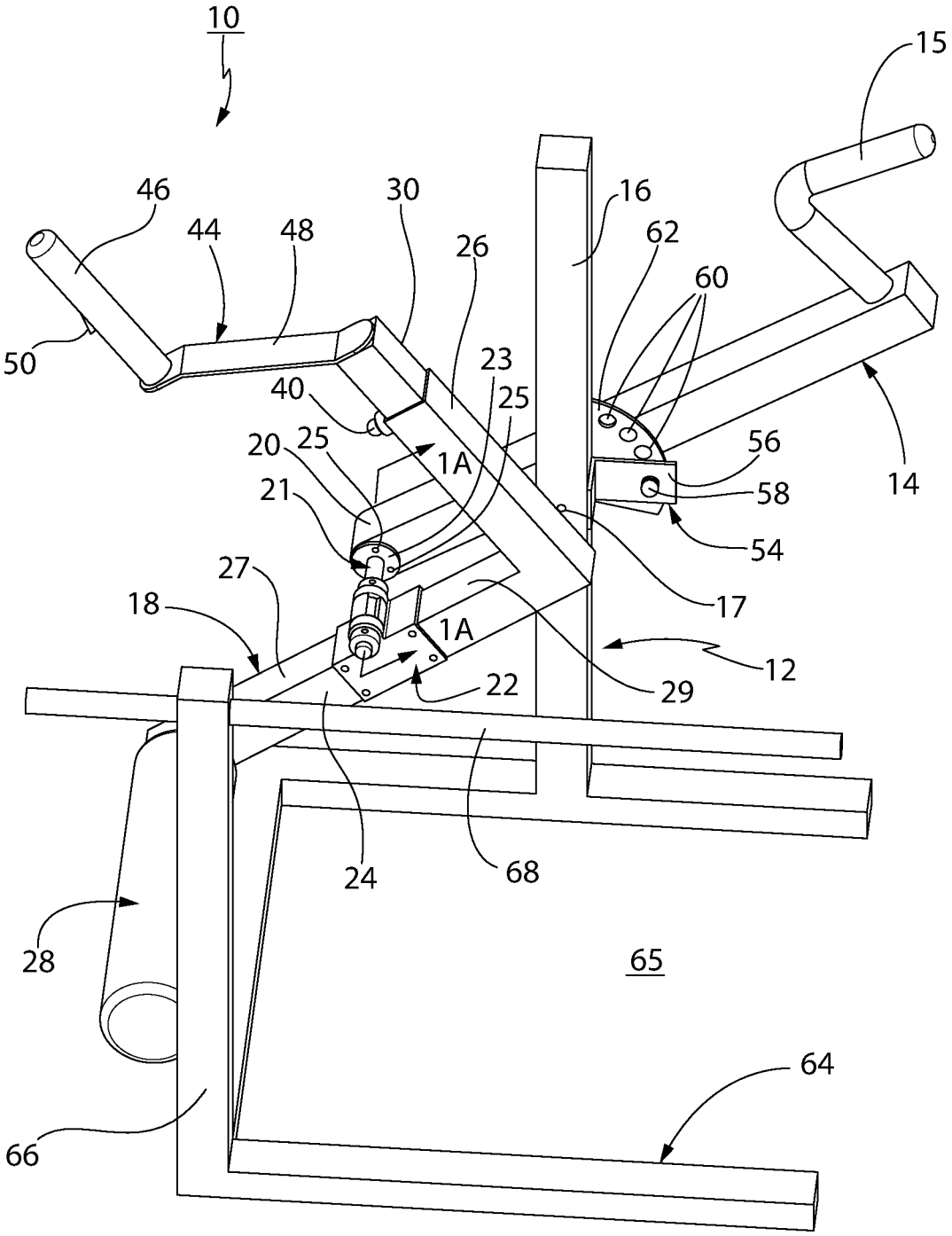
FIG. 1 is an isometric view of a device for stretching hamstring muscles in accordance with this invention, with the rotational mount for the stretching member in its lowermost, vertical position.
Figure 2:
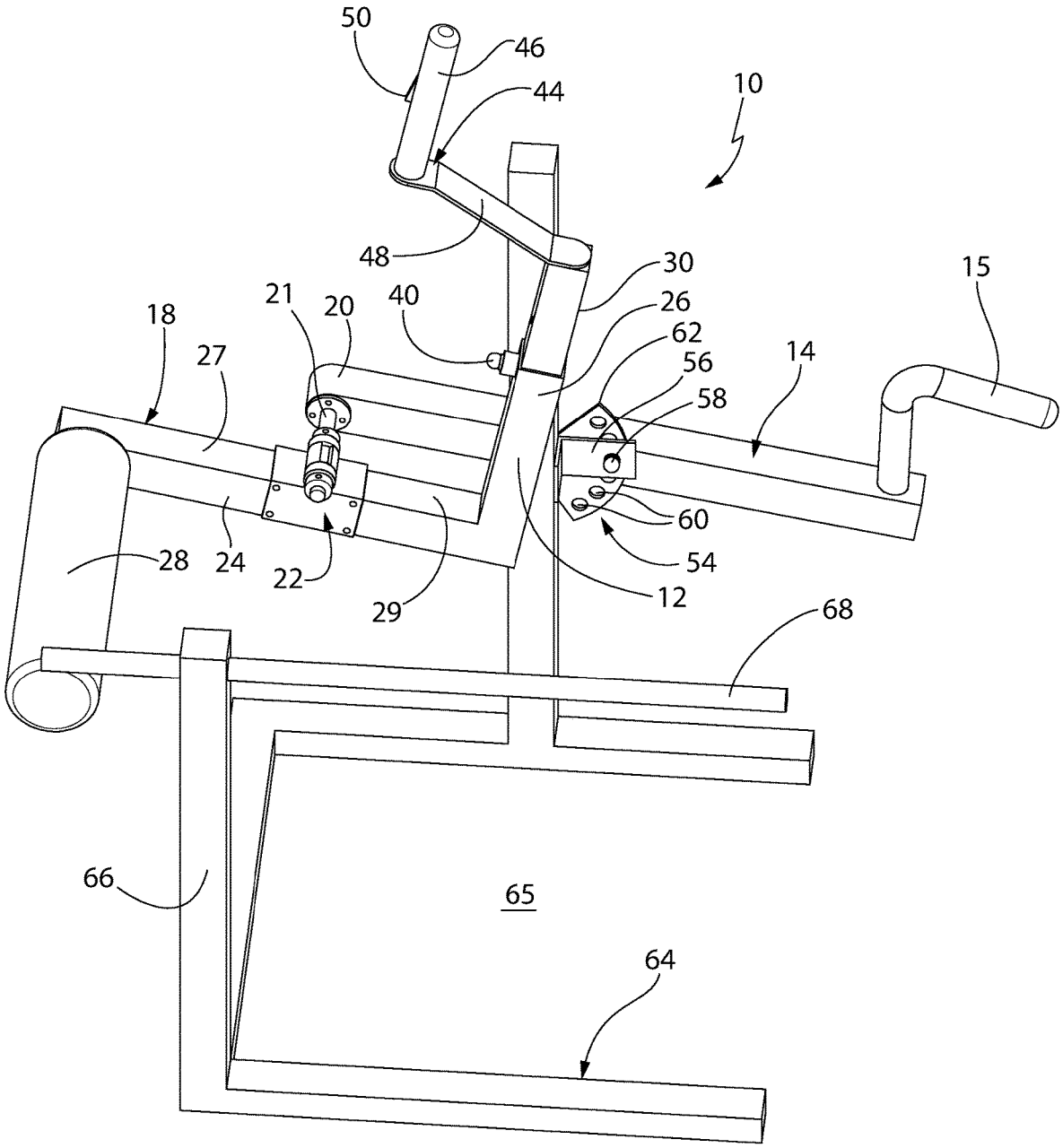
FIG. 2 is an isometric view similar to FIG. 1, but showing the rotational mount for the stretching member in a vertical position higher than shown in FIG. 1, and with the device in a different position than shown in FIG. 1 and with a change in the position of the manually-operated handle assembly relative to that shown in FIG. 1.
Figure 3:
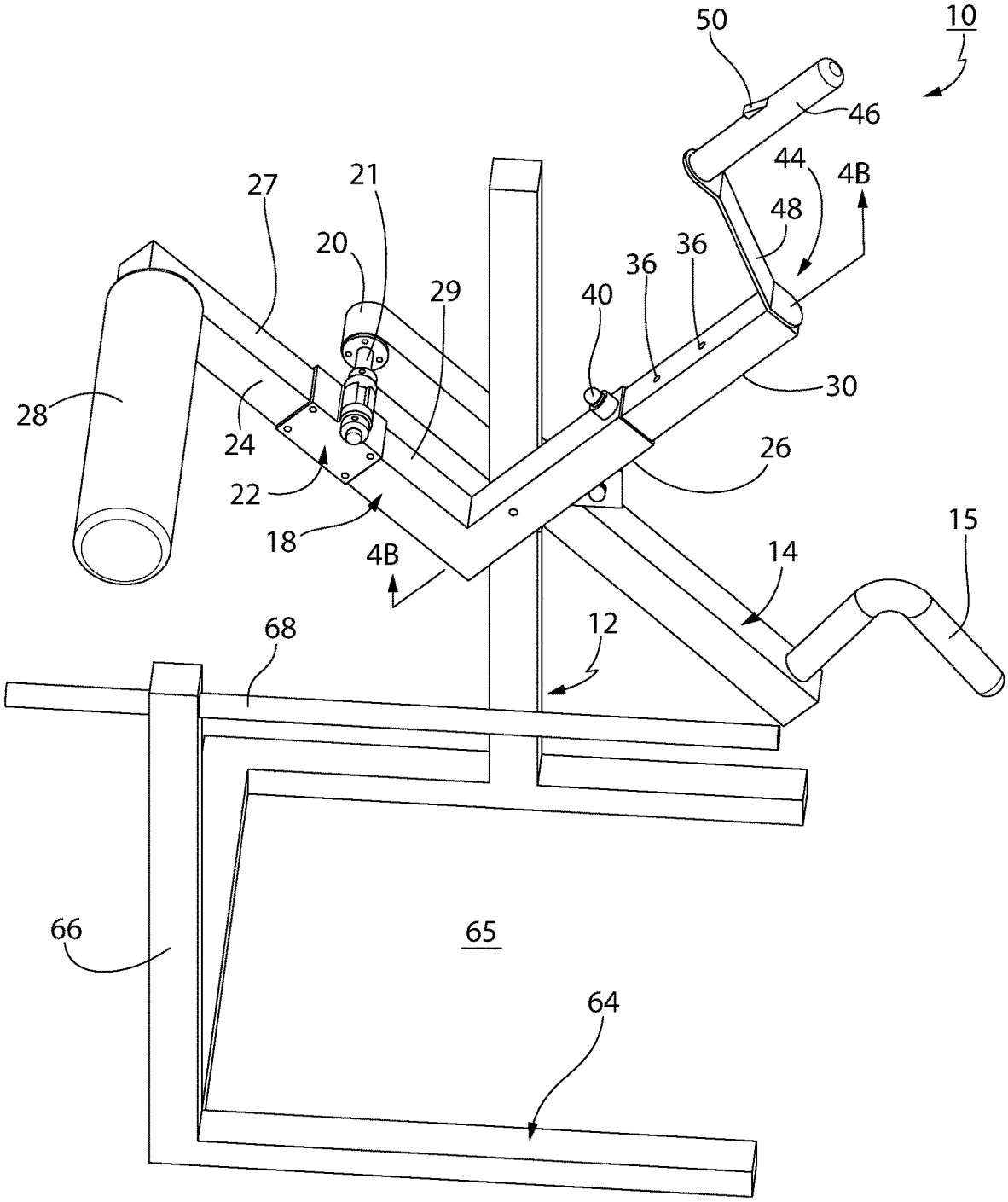
FIG. 3 is an isometric view similar to FIGS. 1 and 2, but showing the rotational mount for the stretching member in its highest vertical position and with the stretching member in a rotational position in which an individual's hamstring muscles are in a stretched condition.

A device for stretching hamstring muscles of an individual is shown generally at 10 in FIGS. 1-3.

Referring to FIGS. 1-3, the device 10 includes a frame assembly 12. A rotational mount 14 is rotatably connected to frame member 16 through axle 17. The rotational mount 14 includes a handle 15 at a proximal end that is intended to be employed to manually rotate the mount for adjustment of the device 10, as will be explained in greater detail hereinafter.

A manually actuatable stretching member 18 is rotationally connected to a distal end 20 of the rotational mount 14 through a second rotational mount 22. The rotational mount 22 is rotatable about a fixed axle 21 having a flange 23 that is secured to the distal end 20 of the rotational mount 14 by bolts 25. The manner of mounting the axle 21 against rotation is not a limitation on the broadest aspects of this invention. Any means can be employed to mount the axle 21 against rotation, e.g., a key/slot arrangement; a weldment, etc.

A clutch mechanism 100 (FIGS. 4B and 4C) to be described in detail hereinafter is employed either to prevent or permit rotation of the stretching member 18 about the fixed axle 21, as desired. Suffice it to state that the clutch mechanism 100 employs a clutch that normally is maintained, or biased in a first position for preventing rotation of the stretching member 18 about axle 21, and is operable to move the clutch into a second position to permit rotation of the stretching member 18 about axle 21, when desired. Details of the clutch mechanism 100 will be described hereinafter.

Reference to "clutch mechanism" in accordance with the broadest aspects of this invention, unless specified otherwise, includes any mechanism, regardless how actuated, e.g., manually, electrically, pneumatically, etc., that is moveable between two positions; one for preventing rotation of a member and the second for permitting rotation of member.

Referring to FIGS. 1-3, the stretching member 18 includes an L-shaped member having sections 24, 26 extending 90 degrees from each other, a foot support 28 and a gripping member 44. The rotational mount 22 is connected to section 24 intermediate its ends to provide a first segment 27 extending on one side of the rotational mount 22 and a second segment 29 extending on the opposed side of the rotational mount. The foot support 28 of the stretching member 18, preferably in the form of a cylindrical member, is connected adjacent a distal end of the first segment 27 and extends laterally therefrom.

Referring to FIGS. 2 and 3, the second segment 29 of the stretching member 18 includes a part of section 24, the section 26 oriented at 90 degrees relative to section 24 and the gripping member 44. The gripping member 44 is adjustably connected to section 26, in a linear direction, through segment 30 of the gripping member 44 being telescopically adjustable within a hollow interior of section 26 of the stretching member 18. As will be explained hereinafter the gripping member 44 preferably is linearly adjustable to accommodate exercisers of different heights. Specifically the segment 30 includes linearly-spaced-apart passages 36 (FIG. 3); a selected one being engaged by a spring-loaded pin 40 retained in section 26 to permit the linear adjustability of the segment 30 relative to section 26.

As can be seen in FIG. 2, the gripping member 44 has a handle 46 and a support arm 48, said support arm 48 being attached to the linearly adjustable segment 30 by welding or any other suitable means. The specific means of attaching the support arm 48 to the segment 30 does not constitute a limitation on the broadest aspects of this invention. Moreover, the adjustment of the gripping member 44, although not required in accordance with the broadest aspects of this invention, is preferred to comfortably accommodate individuals of varying heights, as will be explained in greater detail hereinafter.

As can be seen in FIGS. 1 and 2, an actuating microswitch 50 extends outwardly through the handle 46 and is engageable by an individual conducting a stretching exercise to actuate the clutch mechanism 100 and thereby permit the stretching member 18 to be rotated about fixed axle 21 to permit an individual to comfortably place a leg to be stretched on the foot support 28 and thereafter stretch the hamstring muscles, as will be explained in greater detail hereinafter.

Referring to FIGS. 1 and 2, a locking or clutch mechanism 54 is provided either to prevent or to permit rotational movement of the first rotational mount 14 about its rotational axle 17, and to maintain the rotational mount 14 in a desired rotational position during a stretching exercise. The locking or clutch mechanism 54 includes an L-shaped connector 56 attached to frame member 16 and also includes a spring loaded locking pin 58 attached to the connector 56; being normally biased to engage within a desired one of arcuately-spaced-apart openings 60 extending through an engagement plate 62 that is attached to rotate with the rotational mount 14. When the rotational mount 14 is in a desired rotational position the spring loaded locking pin 58 engages within an aligned opening 60 to thereby stabilize, and prevent further rotation of the rotational mount 14.

Referring to FIGS. 1-3, the frame assembly 12 includes a U-shaped base 64 providing an open area 65 to accommodate an individual in the region thereof. The foot support 28 of the stretching member 18 extends laterally across the U-shaped base 64 to permit an individual to place either foot thereon for the purpose of stretching the hamstring muscles of either leg without the individual being required to change the position of his/her feet relative to the device 10.

Reference throughout this application to the U-shaped support accommodating an individual "in the region" of the open area, or descriptions of similar import, includes accommodating the individual both inside the open area 65 provided by the U-shaped base 64 or outside of the open area, but aligned therewith, as may be required by the height or leg length of the individual using device 10 to stretch the hamstring muscles.

Still referring to FIGS. 1-3, the frame assembly 12 includes an upstanding frame member 66 connected to base 64 laterally spaced from frame member 16 and stretching member 18. A support arm or rail 68 is mounted or otherwise attached at the upper end of frame member 66 so that when an individual is engaged in a stretching exercise by engaging handle 46 with one hand and pulling it in a counterclockwise direction as viewed in FIGS. 1 through 3, the individual's other hand (not shown) can engage or rest on the support arm or rail 68 to thereby permit the individual to be stabilized during the stretching exercise. If desired the rail can be mounted for vertical movement through any well-known connection device to accommodate individuals of different heights. However, in accordance with the preferred embodiments of this invention such vertical adjustability is not considered to be required.

Moreover, although in accordance with the broadest aspects of this invention a support arm or rail, e.g., 68 is not required, it is a very desirable feature in the most preferred embodiments of this invention to help stabilize and individual during a stretching operation; with the individual being in a standing position.

Figure 4A:
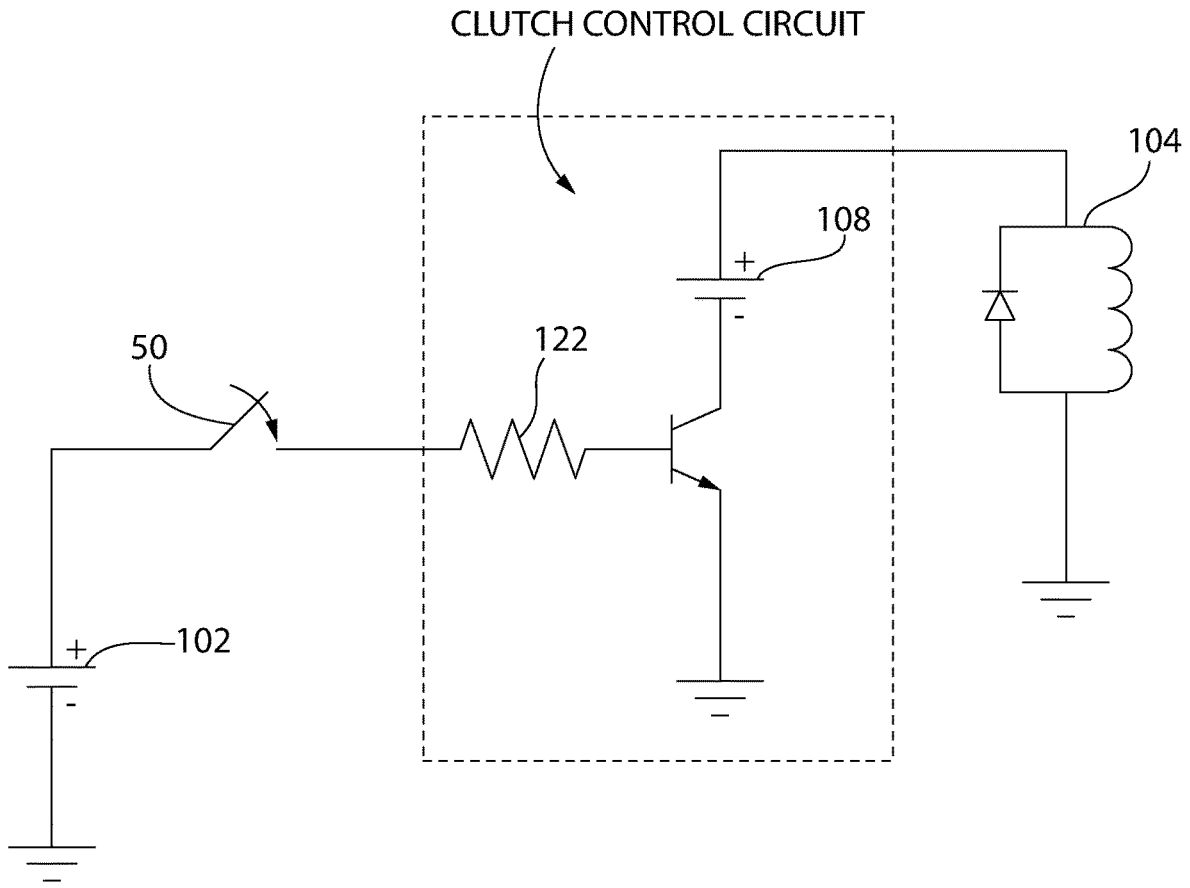
FIG. 4A shows a representative clutch control circuit usable in the hamstring stretching device of this invention and also in the quadriceps stretching device of this invention.

Referring to FIG. 4A, a clutch control circuit is illustrated for controlling the operation of clutch mechanism 100 (FIGS. 4B, 4C, 5A and 5B), which normally is engaged to prevent rotation of the stretching member 18 about the fixed axle 21 secured to the first rotational mount 14. Before discussing details of the clutch mechanism 100, including its control system, details of the second rotational mount 22 first will be described.

Figure 1A:
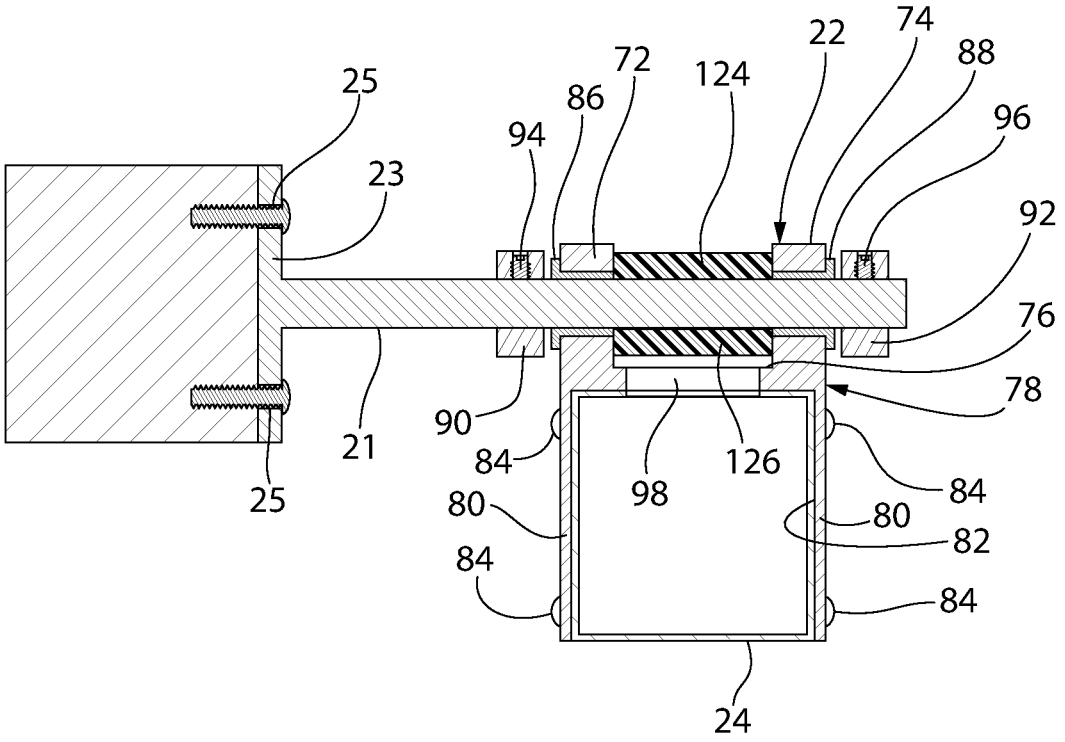
FIG. 1A is a sectional view along 1A-1A of FIG. 1, showing details of the rotational mount for the stretching member.

Referring to FIGS. 1 and 1A the manner of connecting the non-rotational axle 21 to the rotational mount 22 will be explained. Rotational mount 22 includes spaced-apart supports 72, 74 extending upwardly from an upper wall 76 of section 78 that is attached to the first section 24 of stretching member 18. Section 78 includes downwardly directed walls 80 cooperating with upper wall 76 providing a U-shaped opening 82 into which section 24 of the stretching member 18 is positioned. Fasteners 84 in the form of bolts, screws or other suitable fastening device connect the downwardly directed walls 80 of the rotational mount 22 to the first section 24 of the stretching member 18. The spaced-apart supports 72, 74 include low friction bushings 86, 88, respectively; through which the non-rotational axle 21 extends. Lock nuts 90, 92 are connected to the axle 21 adjacent outer surfaces of the spaced-apart supports 72, 74 to maintain the rotational mount 22 in a desired axial position on the non-rotational axle 21. These lock nuts are of a well-known construction including threaded locking screws 94, 96 for frictionally engaging the outer surface of axle 21 to prevent undesired linear movement of the rotational mount 22 on the axle 21. It may not be necessary to including a lock nut on both sides of the rotational mount 22; only on the outer end of support 74 to prevent the rotational mount from sliding axially off of the axle 21 during manual rotation of the stretching member 18. In some instances it may not be necessary to include any lock nuts to retain the rotational mount 22 on axle 21 during operation of the device 10.

Figure 4B:
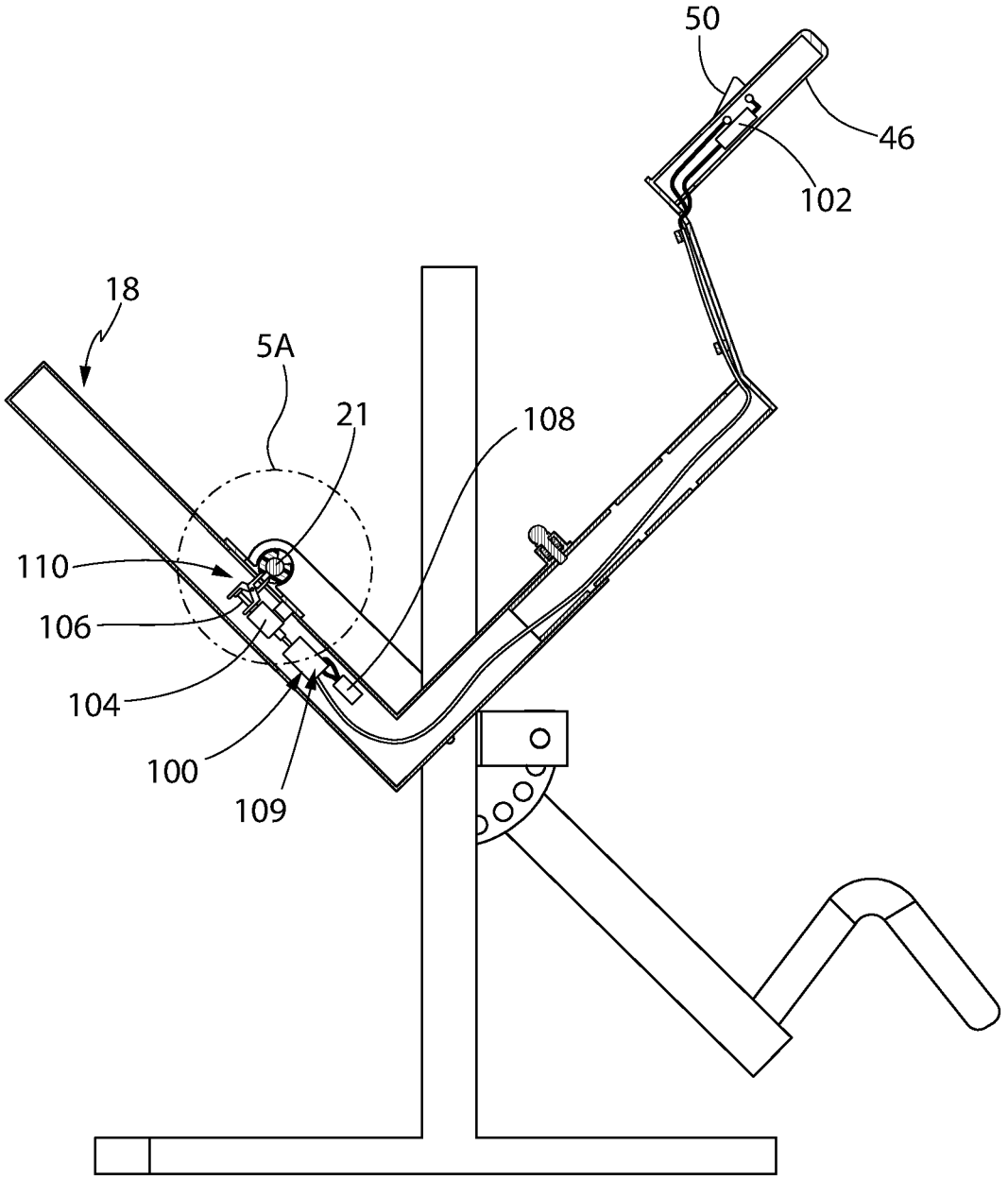
FIG. 4B is a sectional view along line 4B-4B of FIG. 3 showing details of a clutch mechanism employed in this invention; being in a normally engaged condition for preventing rotation of the stretching member about its rotational mount.
Figure 4C:
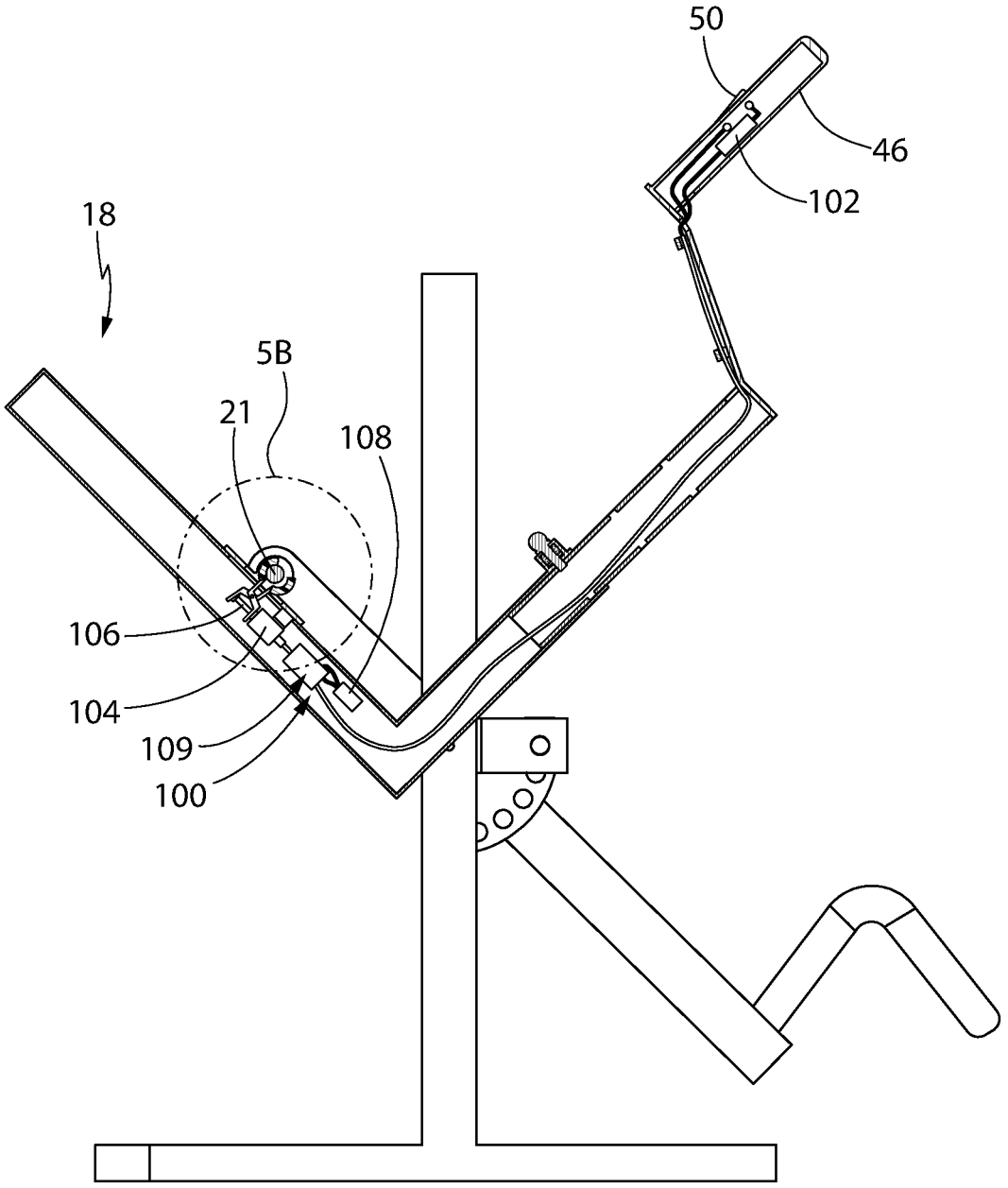
FIG. 4C is a sectional view along line 4B-4B of FIG. 3 showing the clutch mechanism disengaged to permit rotation of the stretching member about its rotational mount.
Figure 5A:
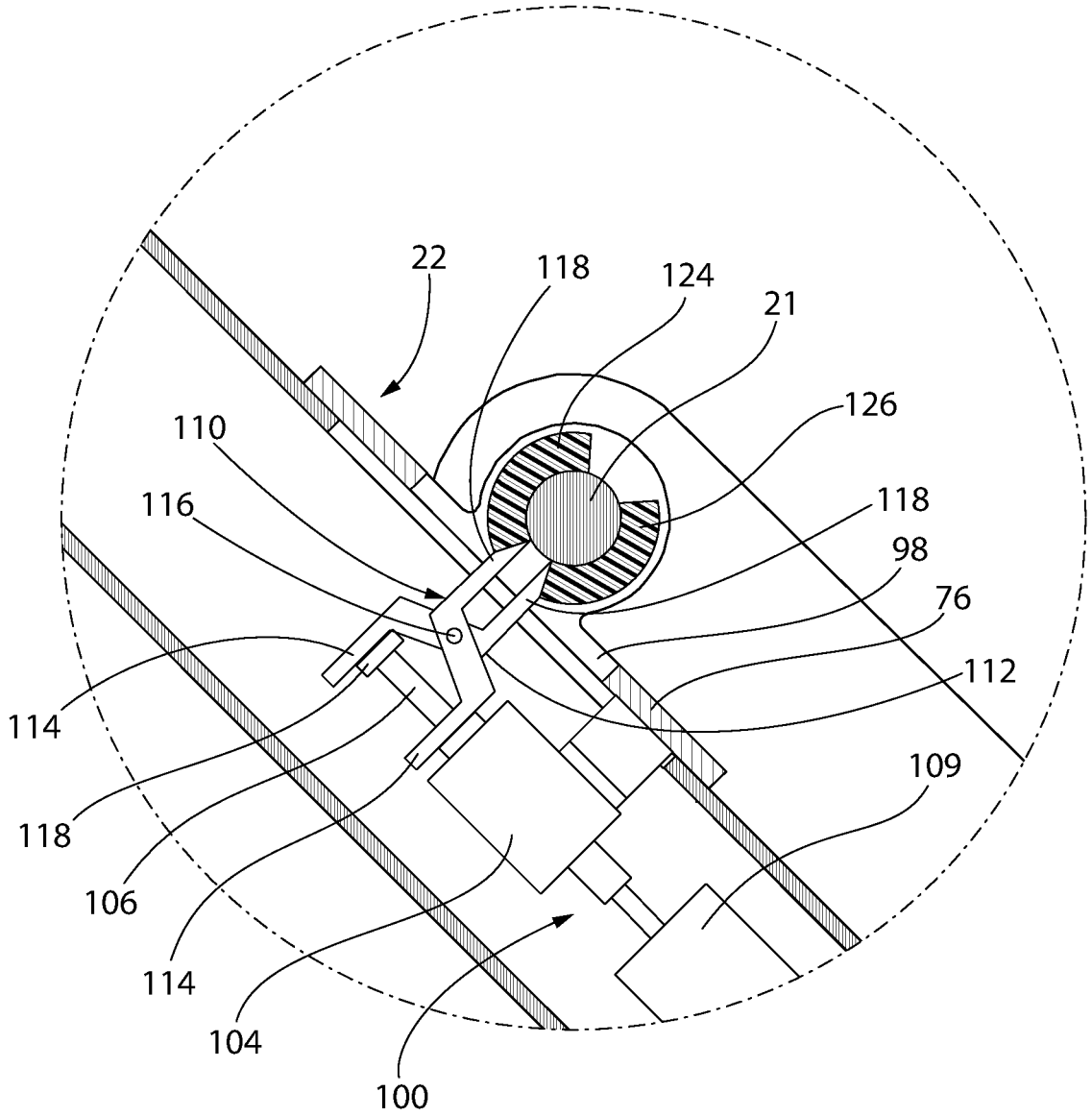
FIG. 5A is an enlarged view of the section identified in phantom as 5A in FIG. 4B showing details of construction with the clutch engaged to prevent rotation of the stretching member about its rotational mount.

Referring to FIG. 1A and FIG. 5A, upper wall 76 of the rotational mount 22 includes a passage 98 to accommodate clutch 110 of the clutch mechanism 100, as described below. The clutch mechanism 100 is omitted from FIG. 1A for purposes of clarity. However, the relationship of the clutch mechanism in the device 10 is shown clearly in FIGS. 4B, 4C, 5A and 5B.

Referring to FIGS. 1, 4A, 4B and 4C, a momentary actuating switch 50 of the clutch mechanism 100 preferably is located in the handle 46 and extends outwardly therefrom, to be actuated when the handle is gripped by an individual engaged in a stretching exercise. Battery 102 of the clutch mechanism 100 also is preferably located in the handle 46 (e.g., FIGS. 4A and 4B). A solenoid 104 includes a displaceable actuator pin 106 controlled by a battery 108 forming part of the clutch control circuit, as shown in FIG. 4A, located adjacent the clutch 110.

Figure 5B:
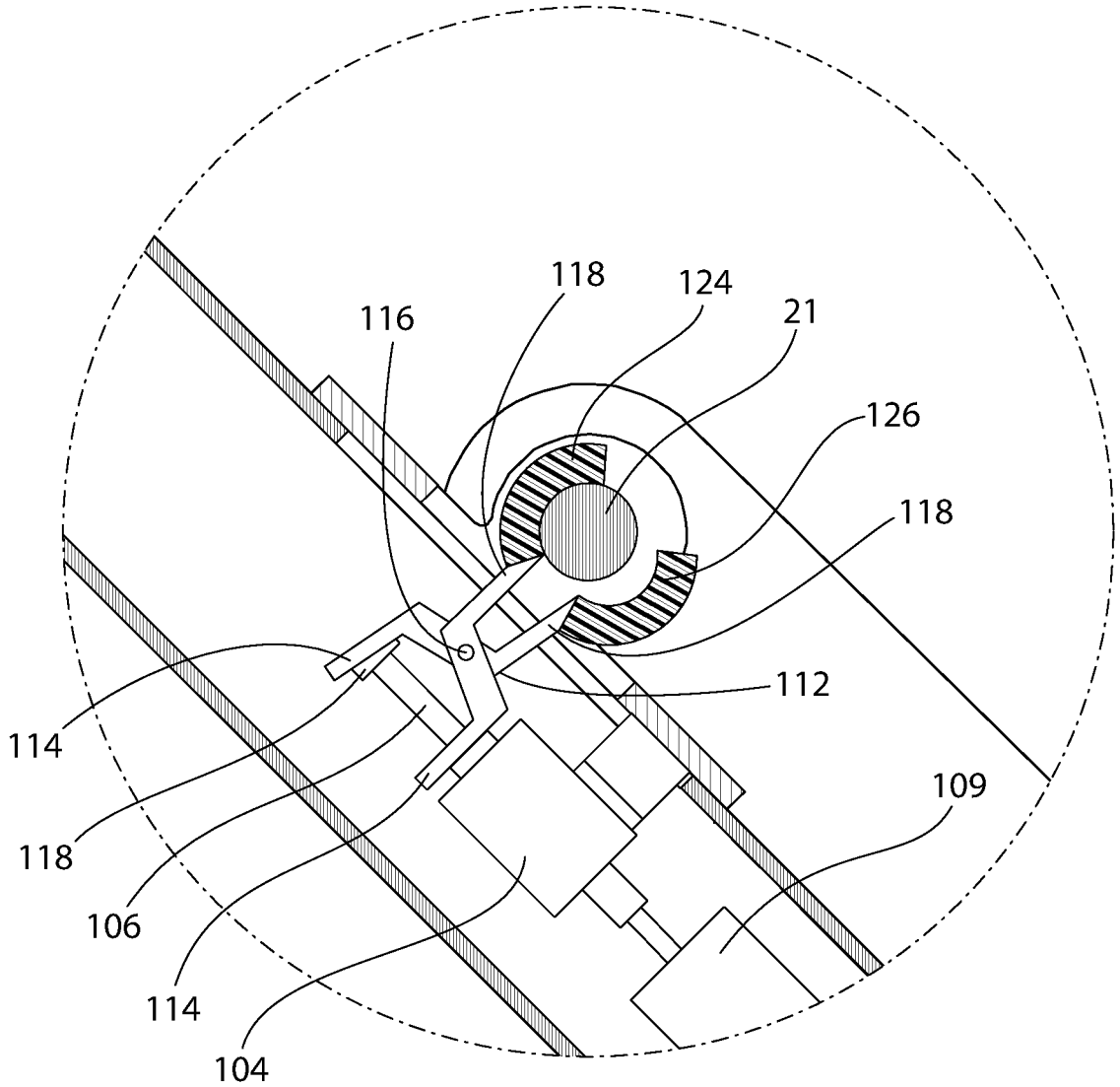
FIG. 5B is an enlarged view of the section identified in phantom as 5B in FIG. 4C showing details of construction with the clutch disengaged to permit rotation of the stretching member about its rotational mount.

Referring to FIGS. 5A and 5B, the clutch 110 is most clearly illustrated and includes a scissor-action actuator 112 having pivotal arms 114 on one side of a pivot axle 116 that normally are biased inwardly with one of said arms being maintained in engagement with a distal end 118 of the actuator pin 106. The actuator 112 includes clutch-release sections 118 on the side of the pivot 116 opposed to the pivotal arms 114.

Referring to FIG. 4A-4C, a representative, conventional clutch control circuit is illustrated and is connected between momentary actuation switch 50 and solenoid 104, which includes the displaceable actuator pin 106 that extends to actuate the clutch 110 when the solenoid 104 is energized by a second battery 108 constituting part of the clutch control circuit. The momentary switch 50 (and preferably, battery 102) are located in the handle 46 (e.g., FIGS. 4B and 4C) whereas the clutch control circuit, and solenoid 104 are located adjacent the clutch 110. As can be seen in FIGS. 4B, 4C, the components of the clutch control circuit, other than battery 108, are retained within a housing 109. The battery 108 preferably is included outside of housing 109 to permit easy removal and replacement of the battery, when required.

Because the momentary switch 50 normally is open, as shown in FIGS. 4A, 4B and 5A, transistor 122 of the control circuit is "off" When the transistor 122 is "off" the second battery 108 is unable to energize the solenoid 104. With the solenoid 104 de-energized, the actuator pin 106 is in a retracted condition and thus the clutch 110 is maintained in a closed condition to prevent rotation, as is shown in FIG. 5A. Specifically, in the closed condition clutch plates 124, 126 remain normally biased against the non-rotational axle 21 to prevent the rotational mount 22 and stretching member 18 connected thereto from rotating on that axle.

Conversely, when the user grips handle 46 and closes momentary switch 50 (FIGS. 4C and 5B) the battery 102 turns "on" transistor 122 in the clutch control circuit. Turning on the transistor 122, closes the clutch control circuit, thereby allowing battery 108 thereof to energize the solenoid 104. As mentioned above, when the solenoid 104 is energized, the actuator pin 106 moves outwardly, thereby opening the clutch 110 to permit rotation of the stretching member 18 about the fixed axle 21. Specifically the clutch release sections 118 of the clutch 110 are biased outwardly to move clutch plates 124, 126 out of their locking engagement with axle 21 to permit rotation of the rotational mount 22 and stretching member 18 attached thereto about the axle. As soon as the user releases the momentary switch 50, e.g., by disengaging the handle 46, the transistor 122 shuts "off," which disconnects the battery 108 from the solenoid 104, thereby de-energizing the solenoid, which in turn causes the actuator pin 106 to automatically return into its normally retracted position. This, in turn, closes the clutch 110; causing clutch plates 124, 126 to engage axle 21 and prevent rotation of the rotational mount 22 and the stretching member 18 about said axle.

Referring to FIGS. 6A, 6B, 7A and 7B, the manner of manually operating the hamstring stretching device 10 of this invention will be described.

Figure 6A:
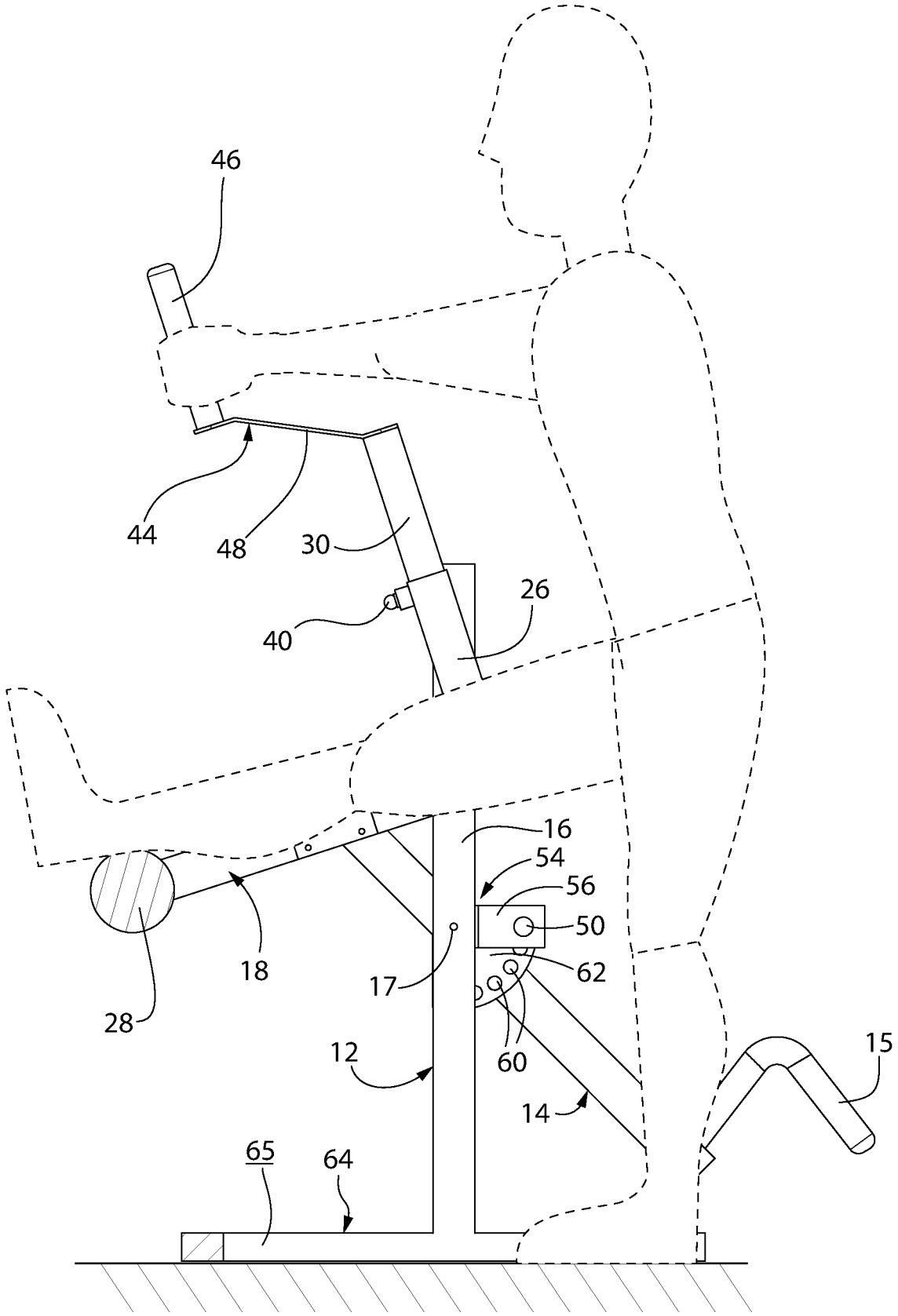
FIG. 6A is a sectional view of the stretching device for hamstring muscles showing an individual to be stretched in phantom and with a leg of said individual in a position prior to stretching and with the rotational mount for the stretching member in its highest vertical position
Figure 6B:
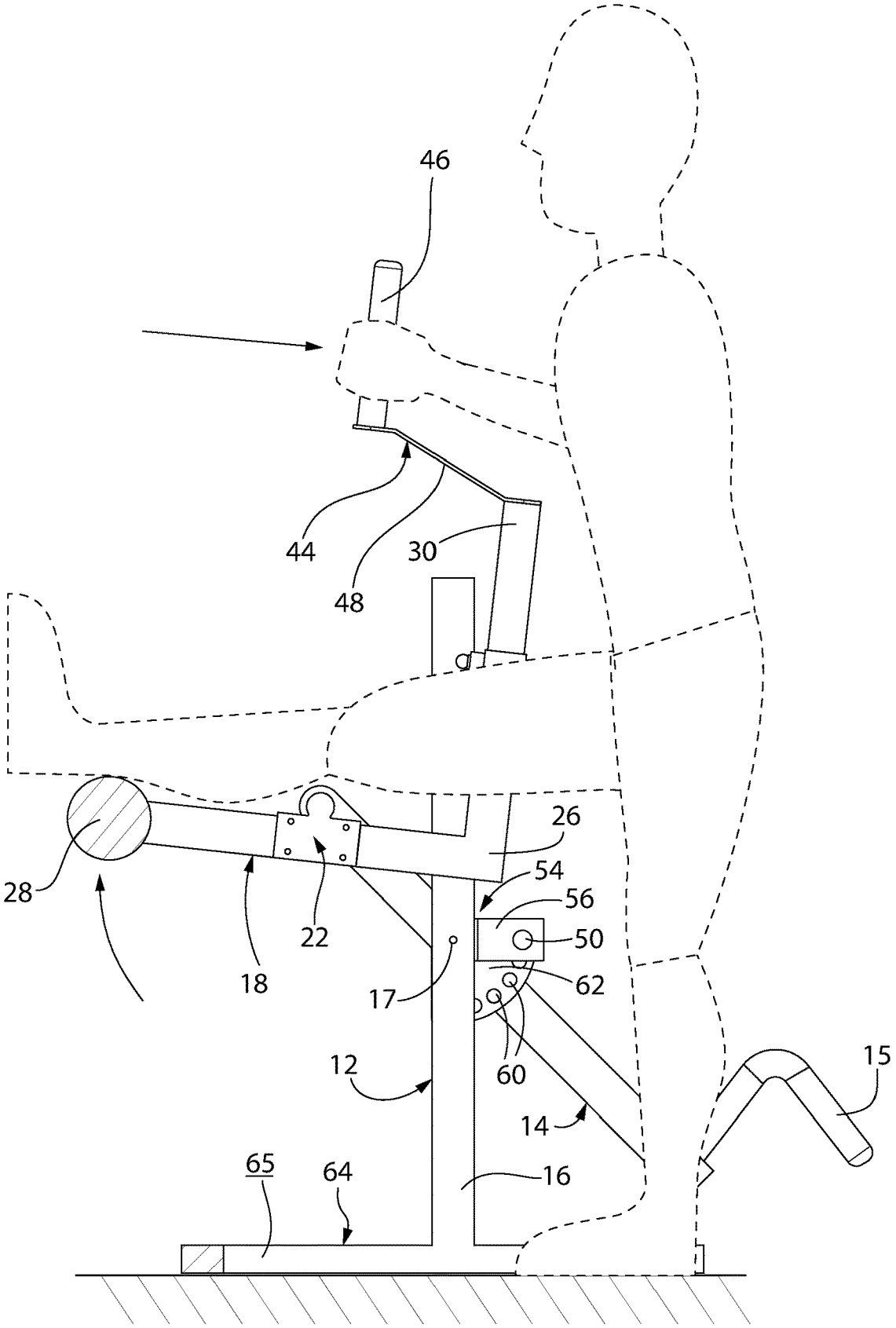
FIG. 6B is a sectional view similar to FIG. 6A but with the hamstring muscles of the individual in the process of being stretched.
Figure 7A:
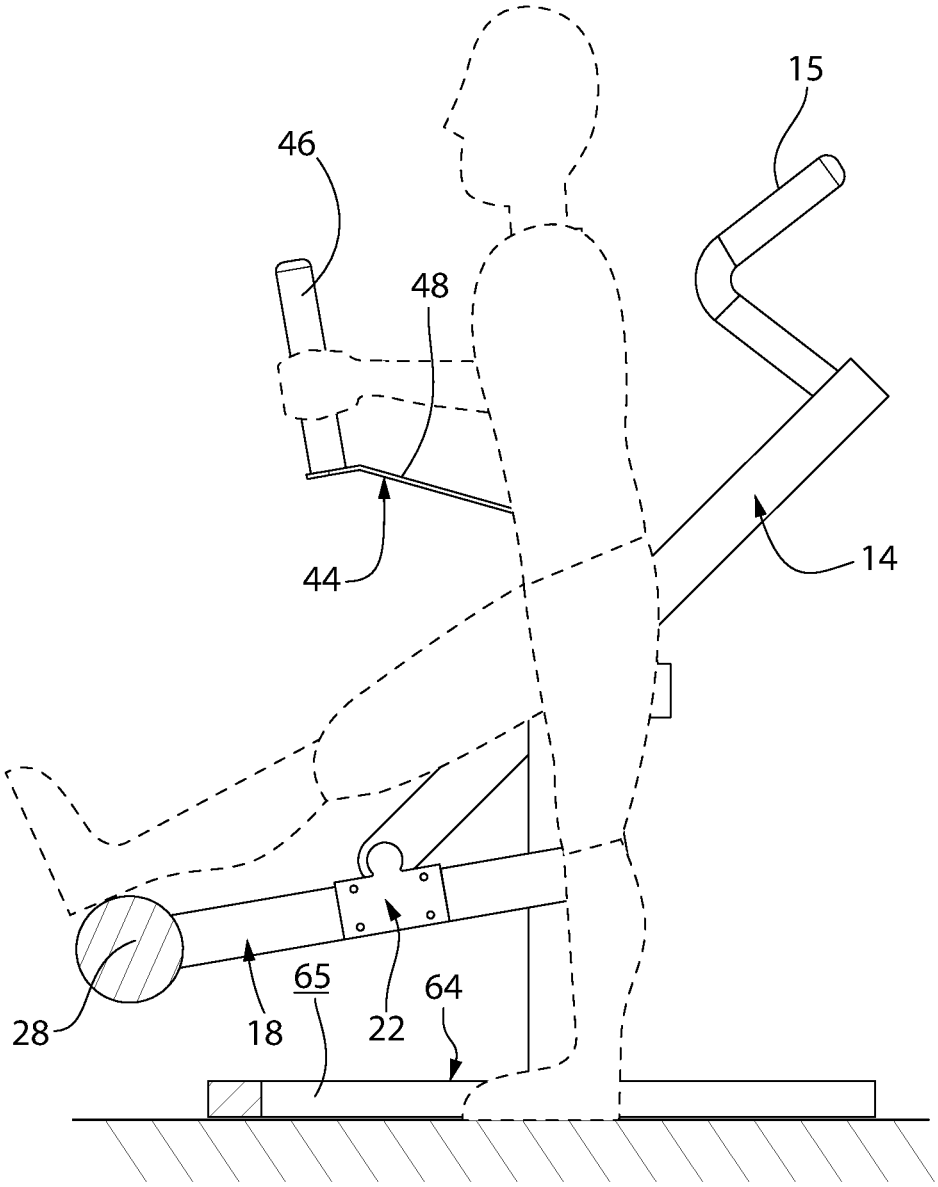
FIG. 7A is a sectional view similar to FIG. 6A, but showing the rotational mount for the stretching member in its lowermost vertical setting as shown in FIG. 1 and being employed by an individual smaller than the individual depicted in FIG. 6A.
Figure 7B:
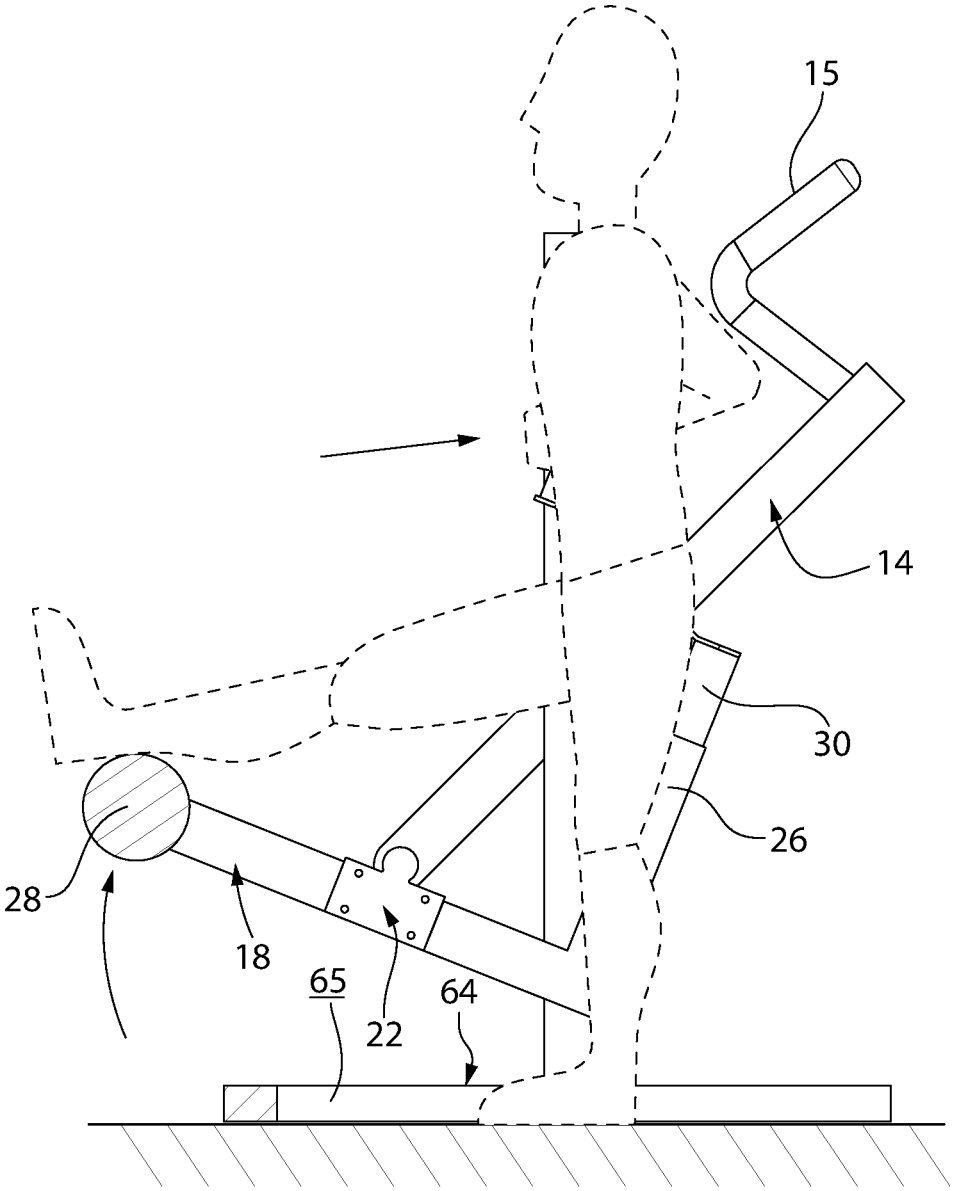
FIG. 7B is a sectional view similar to FIG. 7A, but with the leg of the smaller individual in the process of being stretched.

The individual stretching the hamstring muscles in FIGS. 6A and 6B is taller than the individual shown in FIGS. 7A and 7B to illustrate how individuals of different heights position themselves relative to the device 10 to stretch their hamstring muscles. In other words, the hamstring device 10 is very versatile; accommodating individuals of various heights.

It should be noted that the first rotational mount 14 is rotatably connected to the frame 16 for the purpose of permitting adjustment of the vertical location or height of the fixed axle 21 and the second rotational mount 22 connected thereto relative to the floor or other surface on which the individual is standing. As illustrated in FIGS. 6A and 6B, for a taller person, or a person having a high degree of flexibility the rotational mount 14 is locked by clutch mechanism 54 to position the second rotational mount 22 in the highest vertical position relative to the floor. It should be understood that the rotational mount 14 can be positioned and locked in various different positions, to vary the distance between the axle 21 and the floor, as desired, by the exerciser manually engaging spring loaded locking pin 58 and positioning it within an opening 60 other than the one engaged by the locking pin as illustrated in FIGS. 6A and 6B.

As illustrated in FIG. 6A, the individual is positioned in the region of the U-shaped opening 65 provided by the U-shaped base 64 of frame assembly 12 and is located in a position so that a distal end of the leg to be stretched rests on the foot support 28. As noted earlier the foot support 28 extends laterally across the U-shaped base 64 to permit the individual to support either foot thereon while the individual is generally located in the region of the U-shaped opening 65 of the base 64, without the individual needing to change his/her position relative to the device. In other words, the individual carrying out the stretching exercise can stay in the same position relative to the device 10 to stretch the hamstring muscles of either leg.

As shown in FIG. 6B, the individual grasps handle 46 to actuate the momentary switch 50 and thereby release clutch 100 to permit rotation of the stretching member 18. The individual can then pull the handle 46 of the stretching member 18 in the clockwise direction illustrated in FIG. 6B to thereby rotate stretching member 18 in an arcuate path and thereby stretch the hamstring muscles of either leg.

It also should be noted that the gripping member 44, which includes the handle 46, can be adjusted linearly as a result of support 48 thereof being connected to the linearly adjustable segment 30 thereof. This permits adjustment of the handle 46 to provide comfortable operation of the device 10 by individuals of varying height.

In addition, during the stretching operation the hand that is not engaging the gripping member can be positioned on the support arm or rail 68 (see FIG. 1) to provide stability for the individual carrying out the stretching operation while in a standing position. Although a supporting rail, such as rail 68, is not required in accordance with the broadest aspects of the invention it is a highly desirable feature and one that is not believed to exist in any hamstring stretching device that is employed by an individual in a standing position. In fact, such a rail is not believed to exist in any quadriceps stretching device that is employed by an individual in a standing position, as will be described hereinafter.

Referring to FIGS. 7A and 7B, an individual shorter than the one illustrated in FIGS. 6A and 6B utilizes the device 10 in the same manner as the taller individual. However, in order to accommodate the shorter individual, who in most cases will have a shorter leg, the individual stands closer to the foot support 28 so that the foot of the leg to be stretched rests on the foot support. In addition, the height of the gripping member 44 can be adjusted, e.g., lowered relative to the position employed by a taller individual as shown in FIGS. 6A and 6B, by moving segment 30 thereof into second section 26 of the stretching member 18 to thereby lower handle 46 so that it can be gripped comfortably by a hand of the shorter individual to carry out the stretching operation.

In FIGS. 7A and 7B, the first rotational mount 14 first is rotated through handle 15 and locked into the position illustrated in FIG. 1 by clutch mechanism 54, with the fixed axle 21 and second rotational mount 22 being at the lowest vertical distance from the floor or other support for the individual carrying out a stretching operation. As described in connection with FIGS. 6A and 6B, the rotational mount 14 can be rotated clockwise as illustrated in FIGS. 7A and 7B to raise the vertical position of the axle 21 and second rotational mount 22 relative to the floor or other supporting surface, as desired; thereby providing significant versatility for individuals of different heights and flexibilities to use the device 10. The individual exercising to stretch the hamstring muscles can select a desired height of the axle 21 and second rotational mount 22 to permit the individual to easily place a foot to be stretched on the foot support 28. Thereafter, the individual manually pulls handle 46 in the direction indicated by the arrow in FIG. 7B to thereby rotate the stretching member 18 in a clockwise direction as illustrated in FIG. 7B and thereby stretch the hamstring muscles of either leg of the individual.

The first rotational mount 14 provides for the easy and reliable vertical adjustment of the axle 21 and the rotational mount 22 of the stretching member 18 connected thereto, to accommodate individuals of different heights. The vertical position of the axle 21 and rotational mount 22 determines the lower-most possible position of the stretching member 18 to begin a hamstring stretching operation; it being desirable to provide an initial, low position so that an individual easily can place the leg to be stretched on the foot support 28 while maintaining balance; preferably by additionally engaging the support arm or rail 68 with the hand opposite the one for manually rotating the stretching member 18 through handle 46 to stretch the hamstring muscles of an exerciser.

Referring to FIGS. 8-14B, a device for manually stretching the quadriceps of an individual is shown as 200. Elements in the device 200 that are identical to elements in the device 10 usually will be identified by the same numbers as employed in the device 10, but with the suffix "A" thereafter. However, there may be instances in which elements in the device 200 are the same as elements in the device 10 but are described by numbers different than those employed in identifying those elements in device 10.

Referring to FIGS. 8-10, 12A and 12B, the manual stretching device 200 includes a frame assembly 212 having a frame member 214 including diametrically opposed elongate slot 216 therein.

Figure 8:
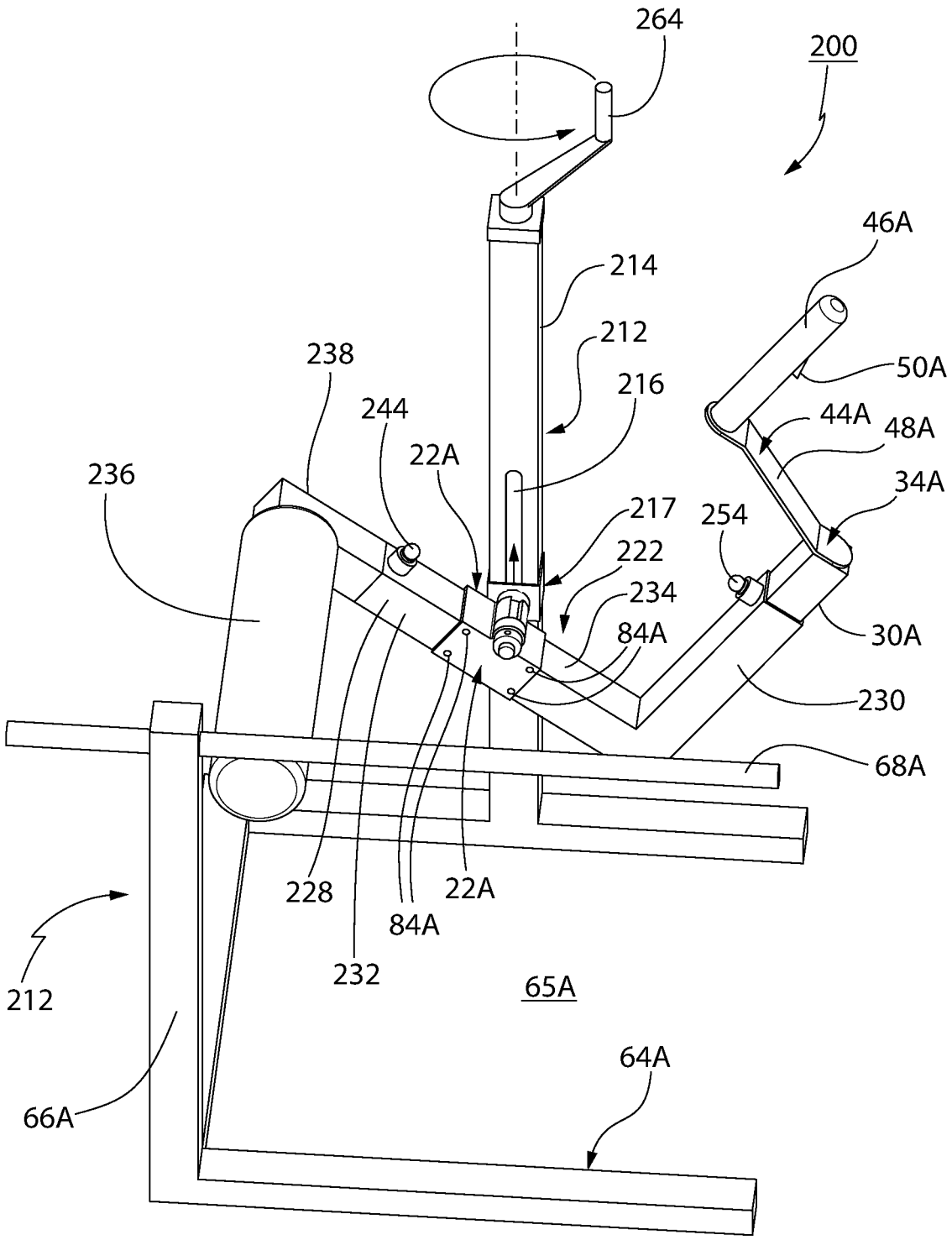
Figure 12A:
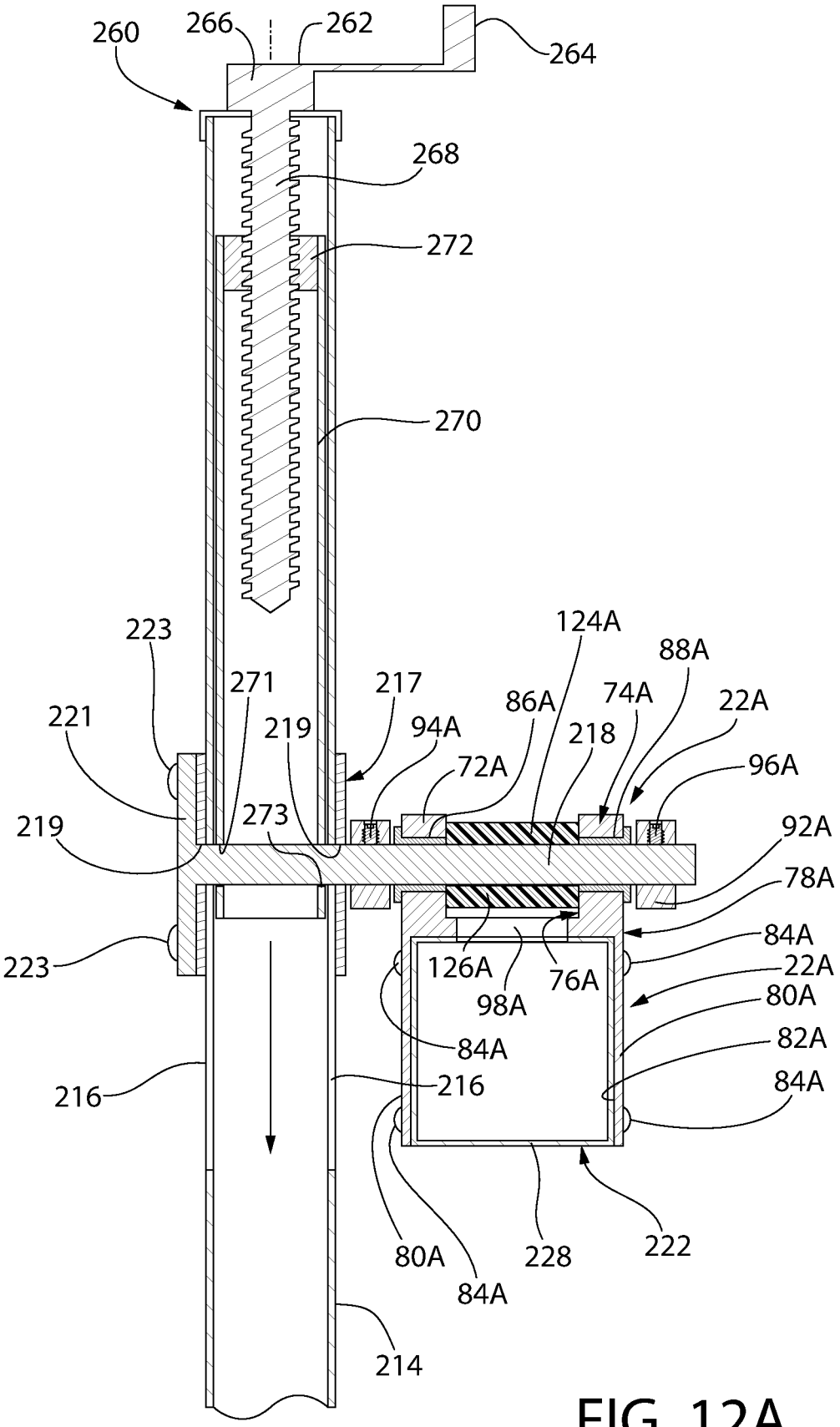
FIG. 12A is a sectional view along line 12A-12A in FIG. 11; showing details of the mechanism for adjusting the vertical position of the rotational mount for the stretching member; showing the mount in its highest vertical position and with details of the clutch mechanism omitted for purposes of clarity.
Figure 12B:
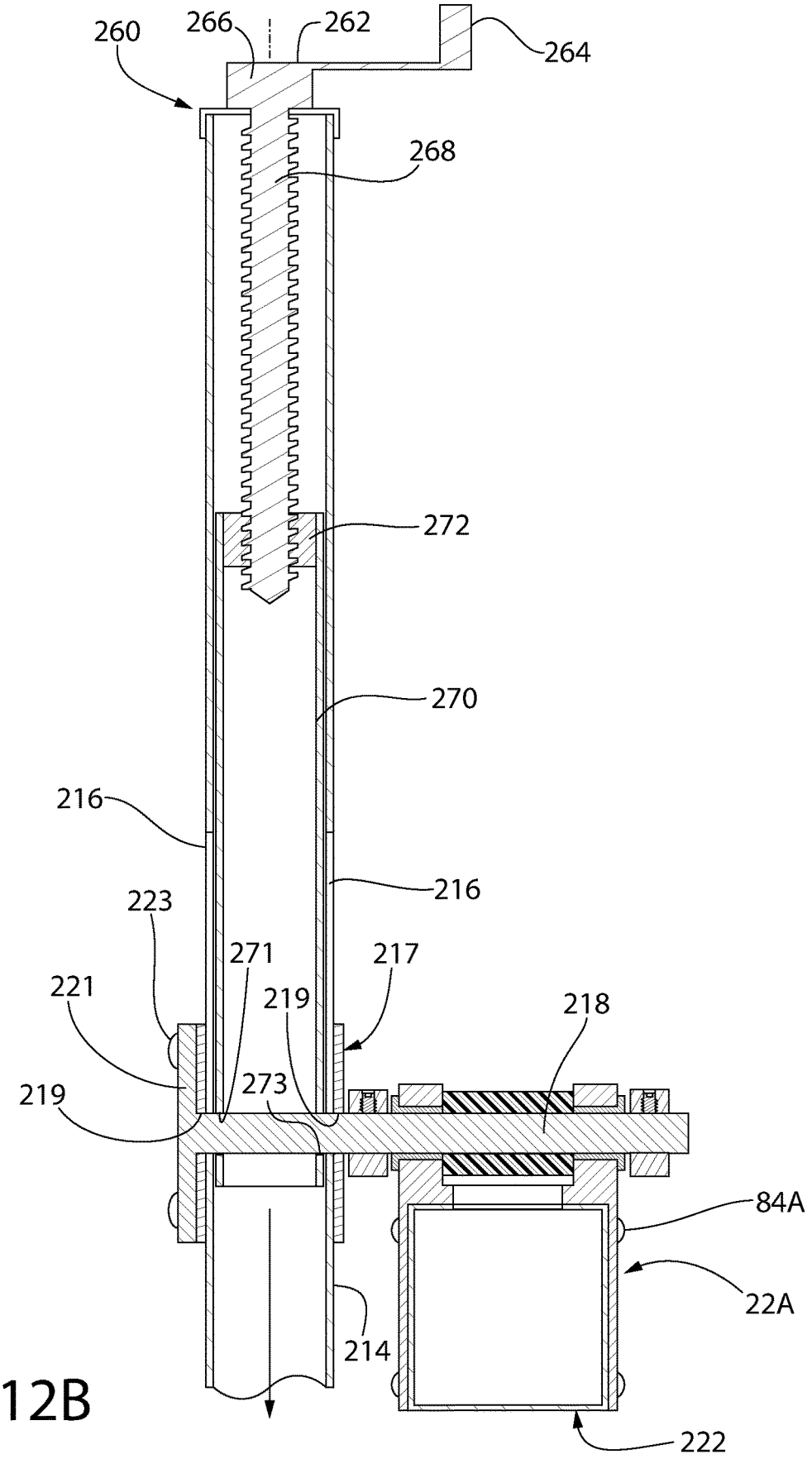
FIG. 12B is a view similar to FIG. 12A but showing the rotational mount adjusted to its lowermost vertical position with details of the clutch mechanism omitted for purposes of clarity.

Referring to FIGS. 8, 12A and 12B, a sleeve 217 slideably engages the outer surface of frame member 214, which in the illustrated embodiment is rectangular. Although the frame member 214 is shown as being rectangular in cross-section any other configuration can be employed. The preferred configuration should be non-circular so that the sleeve 217, which has a corresponding configuration, will not rotate about its axis.

As can be seen best in FIGS. 12A and 12B, diametrically opposed passages 219 are provided through the sleeve 217 for receiving a non-rotatable axle 218 therethrough. The axle 218 also extends through diametrically opposed passages 271, 273 through the lower end of inner sleeve 270 and through the elongate slots 216 in the frame member 214. The non-rotatable axle 218 includes a flange 221 at its proximal end that is bolted or otherwise secured to the sleeve 217 with bolts 223 or any other suitable fasteners. This mounting prevents rotation of the axle 218.

Still, referring to FIGS. 8-10, 12A and 12B, a rotational mount 22A is retained on axle 218 and is rotatably mounted thereon. The rotational mount 22A, in the illustrated embodiment, is identical to rotational mount 22 employed in the stretching device 10 for the hamstring muscles, which is clearly shown in FIGS. 1 and 1A. For purposes of brevity the construction of rotational mount 22A will not be repeated herein, however, as noted earlier in this application, the elements of rotational mount 22A that are the same as the elements in the rotational mount 22 will be identified in FIG. 12A by the same numbers but including the suffix "A" thereafter.

Still referring to FIGS. 11 and 12A, a clutch mechanism 100A, which is identical to clutch mechanism 100 in device 10, employs the same circuit components as shown and described in connection with FIG. 4A, cooperates with the rotational mount 22A and non-rotational axle 218 to either prevent or permit rotation of a stretching member 222 to which the rotational mount 22A is connected in the same manner that clutch mechanism 100 permits or prevents rotation of the stretching member 18 on non-rotational axle 21 of the stretching device 10. For purposes of brevity, details of the construction of clutch mechanism 100A will not be repeated herein. However, as noted earlier in this application, elements of clutch mechanism 100A identical to elements of clutch mechanism 100 will be identified in FIG. 11 by the same number but including a suffix "A" thereafter.

Figure 10:
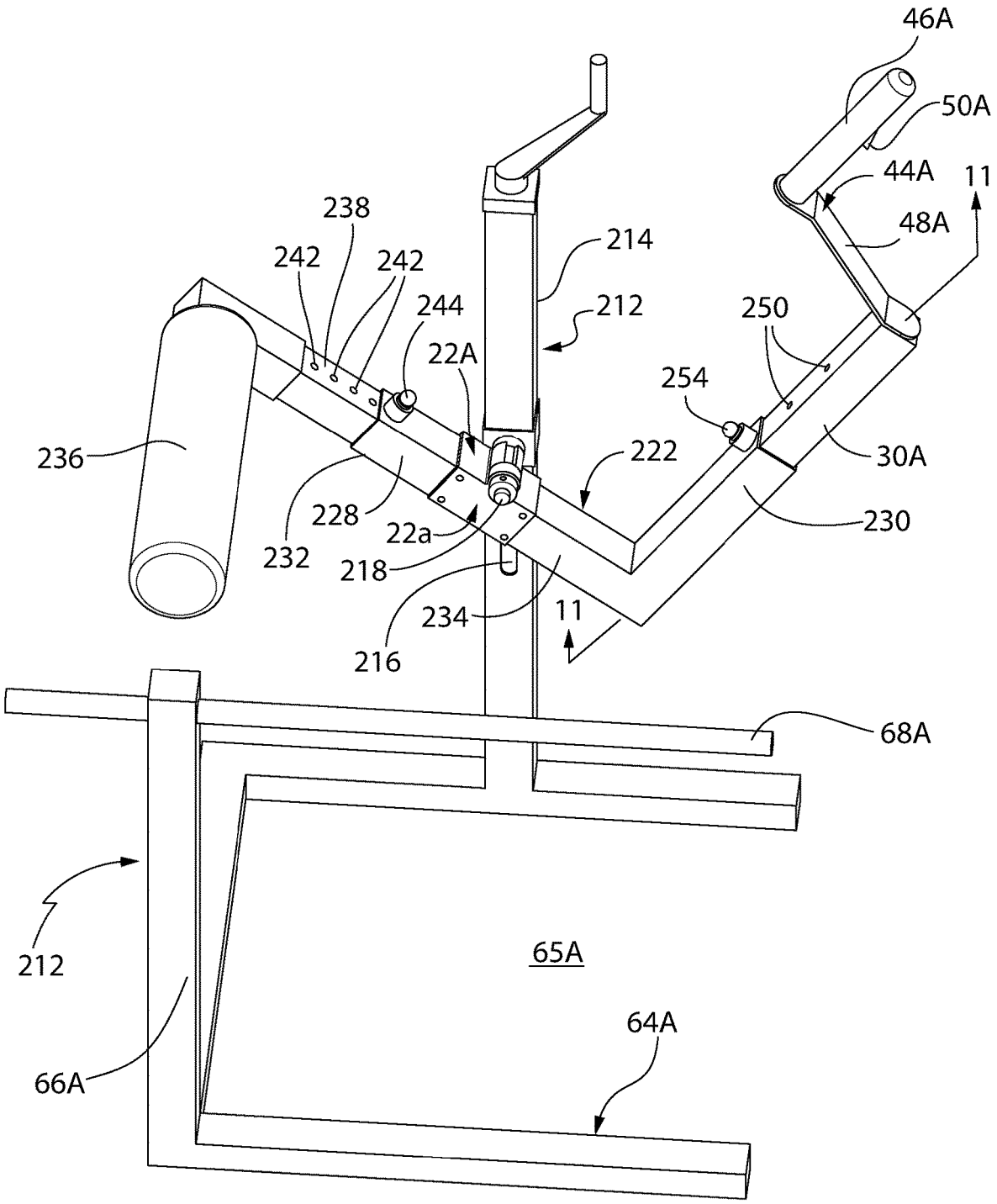
Figure 11:
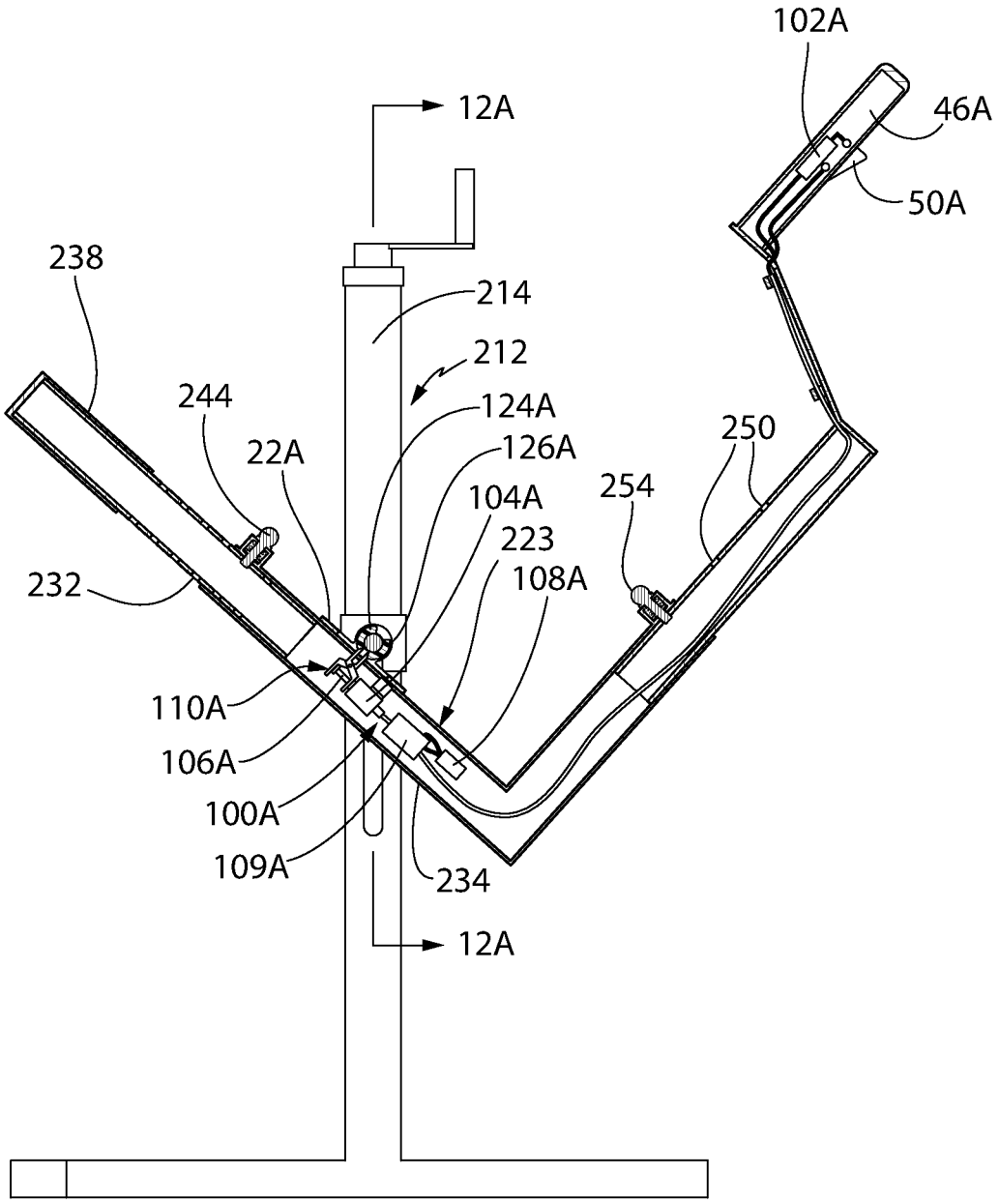

Referring to FIGS. 10 and 11, the stretching member 222 includes a hollow, L-shaped member including arm members 228, 230 disposed 90 degrees from each other, a mounting segment 238 adjustable within arm member 228, a foot support 236 secured to the distal end of mounting segment 238 and a gripping member 44A adjustably attached to arm member 230. The rotational mount 22A for the stretching member 222 is connected to arm member 228 intermediate its ends, in the same manner that rotational mount 22 is connected to the stretching member 18 of the device 10.

As can be seen in FIGS. 8 through 11, the stretching member 222 includes a first section 232 extending from one side of the rotational mount 22A and a second section 234 extending from the other side of the rotational mount. The first section 232 includes mounting segment 238 telescopically mounted within hollow interior of arm member 228 and foot support 236, which preferably, although not necessarily, is cylindrical and is connected to the mounting segment. The mounting segment 238 includes linearly spaced-apart passages 242 (see FIGS. 9 and 10) selectively engageable by a spring loaded pin 244 connected to and extending into hollow interior of arm member 228 to thereby engage a desired passage 242. This permits adjustment of the length of the first section 232 of stretching member 222 between the rotational mount 22A and the foot support 236 to accommodate individuals of different heights, as will be explained in greater detail hereinafter.

Figure 9:
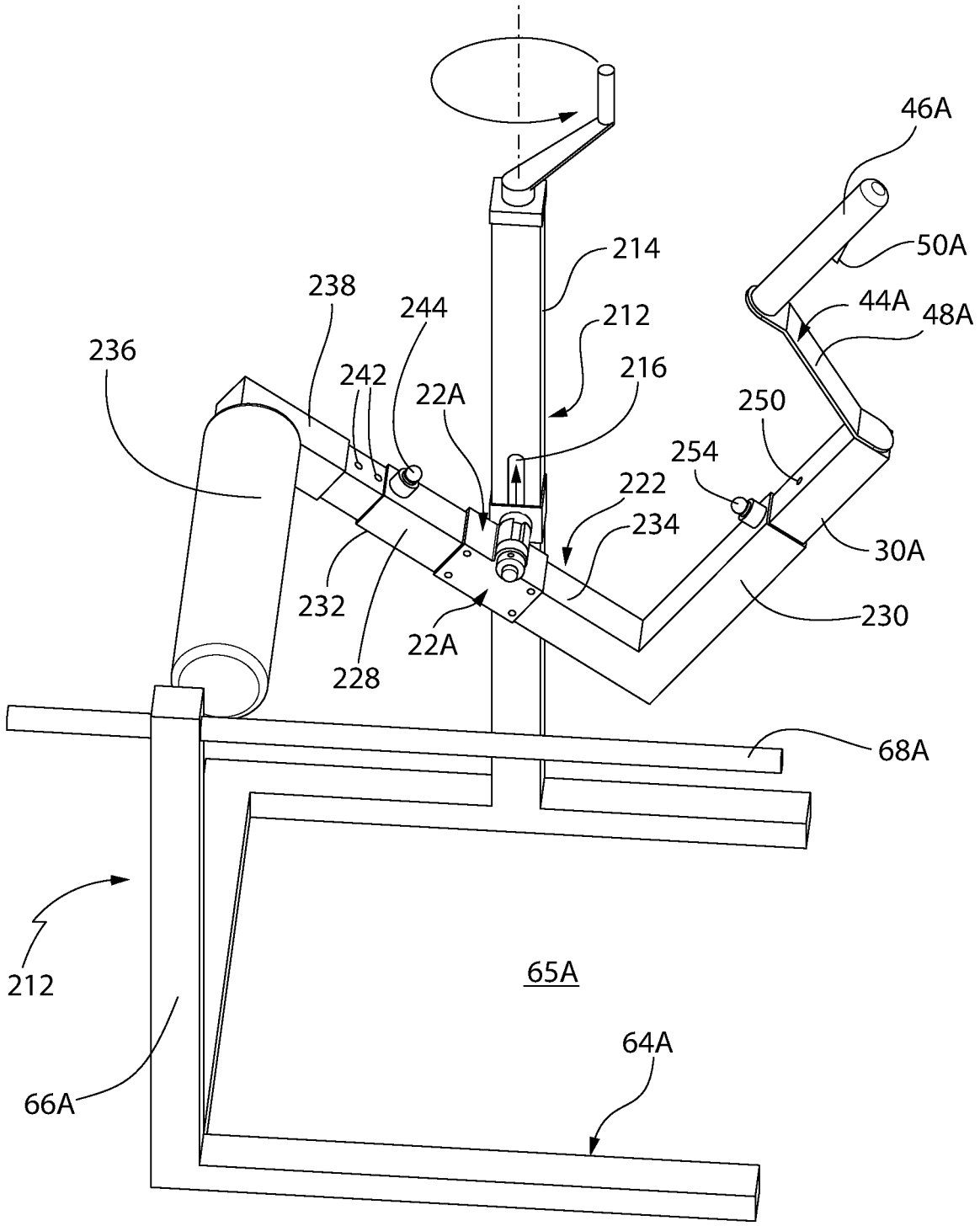

Referring to FIGS. 9 through 11, the second section 234 of the stretching member includes part of arm member 228, the arm member 230 disposed at 90 degrees to arm member 228 and gripping member 44A telescopically mounted within arm member 230.

Still referring to FIGS. 9 through 11, the gripping member 44A, which is part of the stretching member 222 is the same as the gripping member 44 in the device 10; including a handle 46A and a support arm 48A to which the handle 46A is attached. The support arm 48A is attached at its opposite end to a linearly adjustable segment 30A telescopically positioned within the hollow interior of arm member 230 of the stretching member 222.

Still referring to FIGS. 9 through 11, a spring loaded pin 254 is connected to upstanding hollow arm member 230 of the stretching member 222 and normally is biased inwardly into the hollow interior of the arm member 230 to engage within a desired passage 250; thereby permitting linear adjustment of the gripping member 44A to accommodate exercisers of different heights, as will be explained in greater detail hereinafter. Although this adjustability is provided in the preferred embodiment of the invention and is a desirable feature thereof, in accordance with the broadest aspects of this invention the adjustability feature of the gripping member 44A may not be employed.

Referring to FIGS. 12A and 12B, details of the mechanism for controlling the vertical position or height of the rotational mount 22A is disclosed at 260. Specifically, the adjustment mechanism 260 includes a rotationally mounted, threaded adjustment screw 262 rotatable in either rotational direction through handle 264 attached to an upper head 266 of the screw to either raise or lower the rotational mount 22A. The adjustment screw 262 includes a threaded stem 268. The hollow, vertically adjustable member 270 is mounted within the interior of hollow frame 214 and includes a threaded plug 272 at the upper end for cooperating with the threaded stem 268 received therein.

As is illustrated in FIGS. 12A and 12B, and discussed earlier, a non-rotational axle 218 is connected to slidable sleeve 217 and extends through the diametrically opposed elongate slots 216 in the frame member 214 and passes through axially aligned apertures 271, 273 at the lower end of the vertically adjustable member 270. The rotational mount 22A connected to the stretching member 222 is rotationally mounted on the non-rotational axle 218, in the same manner that the rotational mount 22 is connected to the non-rotational axle 21 of the device 10. Also, as is the case with rotational mount 22, the rotational mount 22A may not require both locking nuts 94A, 96A; or for that matter either locking nut.

Referring to FIGS. 8-10, the quadriceps stretching device 200 includes a U-shaped base 64A forming part of the frame assembly 212. This U-shaped base 64A is of the same construction as U-shaped base 64 of the device 10; providing a U-shaped open area 65A for accommodating an individual in the region thereof when the individual is stretching his/her quadriceps, as shown in FIGS. 13A, 13B, 14A and 14B.

Still referring to FIGS. 8-10, the frame assembly 212 includes an upstanding frame member 66A, which is the same as the upstanding frame member 66 employed in the device 10, and which is connected to U-shaped base 64A laterally spaced from frame member 214 and the stretching member 222 in the same manner that upstanding frame member 66 is laterally spaced from frame member 16 and stretching member 18 of the stretching device 10.

A support arm or rail 68A is mounted/attached at the upper end of frame member 66A in the same manner that support arm or rail 68 is mounted/attached at the upper end frame member 66 in the device 10, so that when an individual is stretching the quadriceps, by engaging and manually pulling handle 46A with one hand, the other hand can engage or rest on the support arm or rail 68A to stabilize the individual in a standing position during the stretching exercise. As in device 10, the arm or rail can be mounted for vertical adjustability if desired, although such a mounting is not considered necessary in accordance with the most preferred embodiments of this invention.

Details relating to the use of device 200 for stretching the quadriceps of an individual will be described in connection with FIGS. 13A, 13B, 14A and 14B. The difference between FIGS. 13A and 13B, on the one hand, and FIGS. 14A and 14B, on the other hand, is that the individuals are of a different heights and the device 200 is adjusted from its settings in FIGS. 13A, 13B to comfortably accommodate the smaller individual shown in FIGS. 14A and 14B.

When the quadriceps are to be stretched, the individual bends his/her leg upwardly and rearward about the knee, as shown in FIGS. 13A-14B. It is desirable that the rotational axis of the rotational mount 22A be located in axial alignment with the exerciser's knee, thereby requiring vertical adjustment of the rotational mount 22A relative to the floor or other supporting surface for the individual; depending on the vertical height of the individual's knee above said floor or other supporting surface.

Figure 13A:
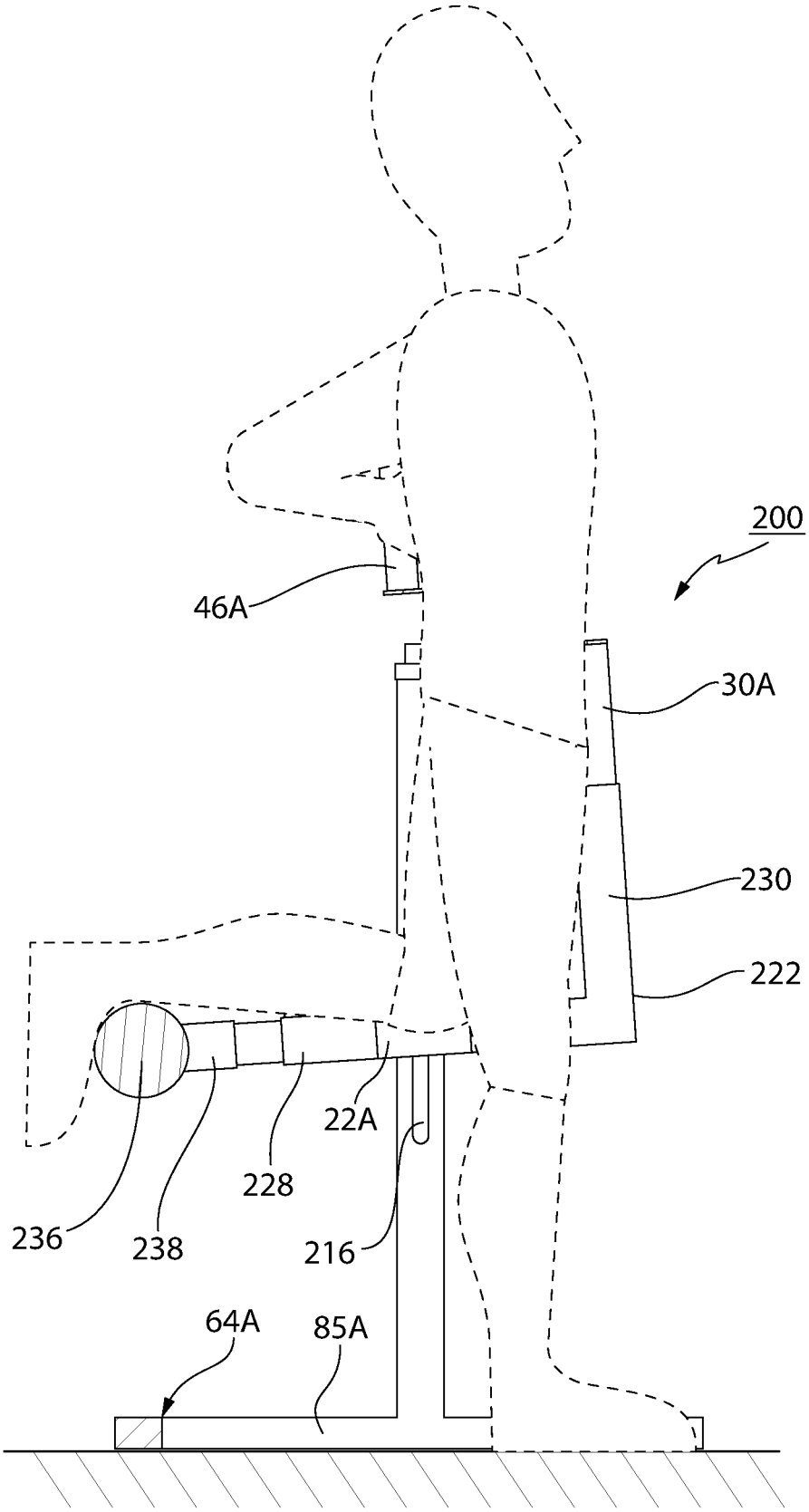
FIG. 13A is a side sectional view of the device for stretching the quadriceps of an individual with the vertical mount for the stretching member in its highest vertical position and showing an individual to be stretched in phantom representation with a bent leg on the stretching member prior to being stretched.
Figure 13B:
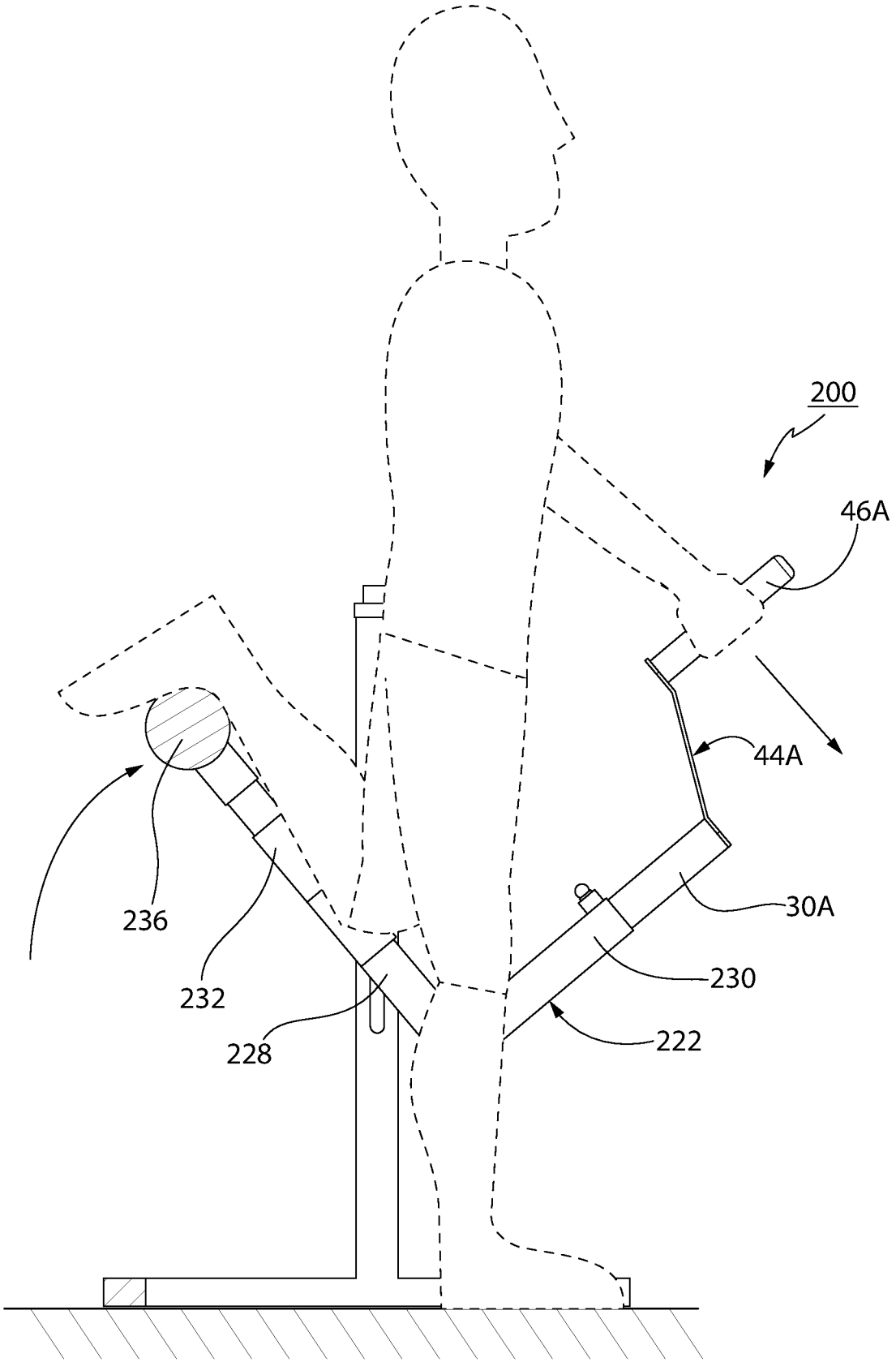
FIG. 13B is a side sectional view similar to FIG. 13A with the quadriceps of the individual's bent leg in the process of being stretched.
Figure 14A:
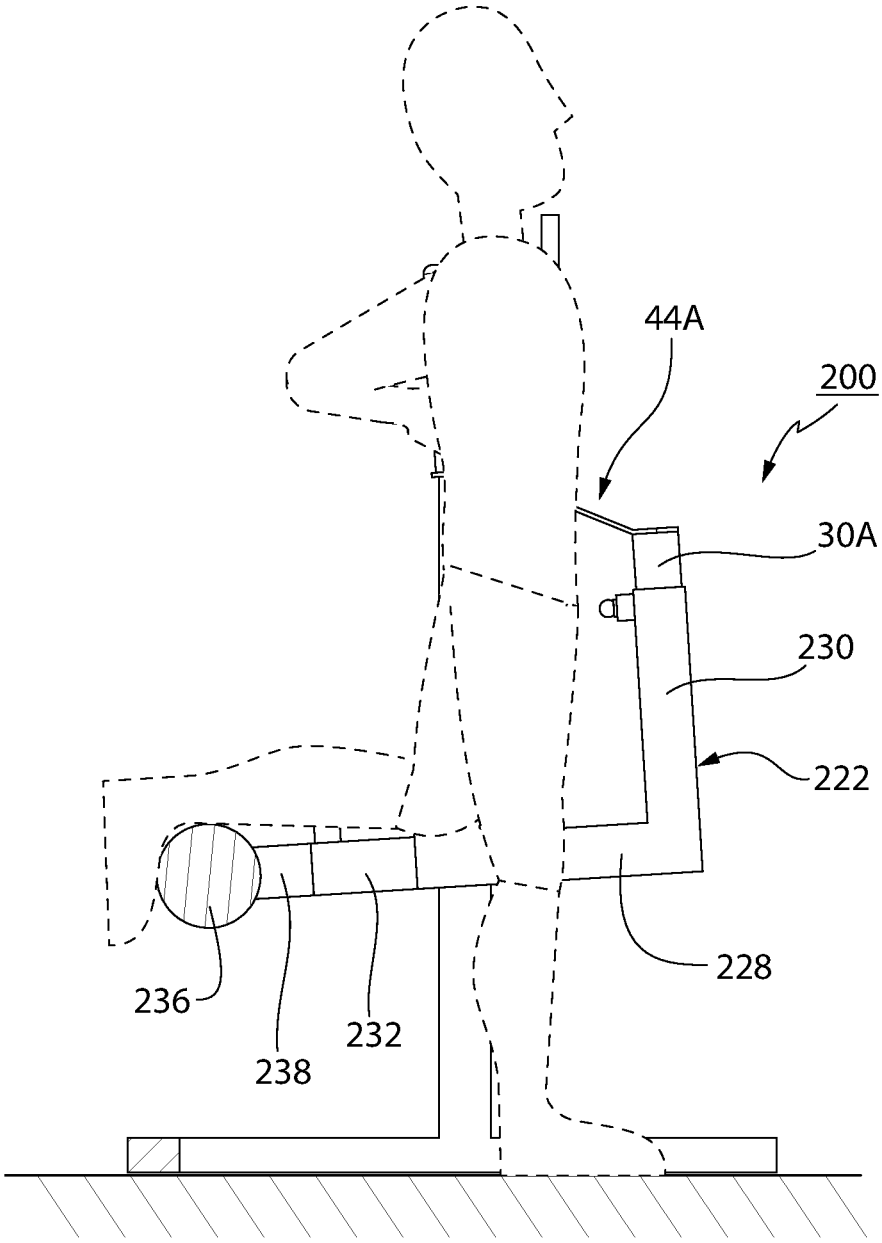
FIG. 14A is side sectional view of the device for stretching the quadriceps of an individual, shown in phantom representation, with the vertical mount for the stretching member in a vertical position lower than that in FIGS. 13A and 13B, to stretch the quadriceps of the individual, said individual being shorter than the individual depicted in FIGS. 13A and 13B.
Figure 14B:
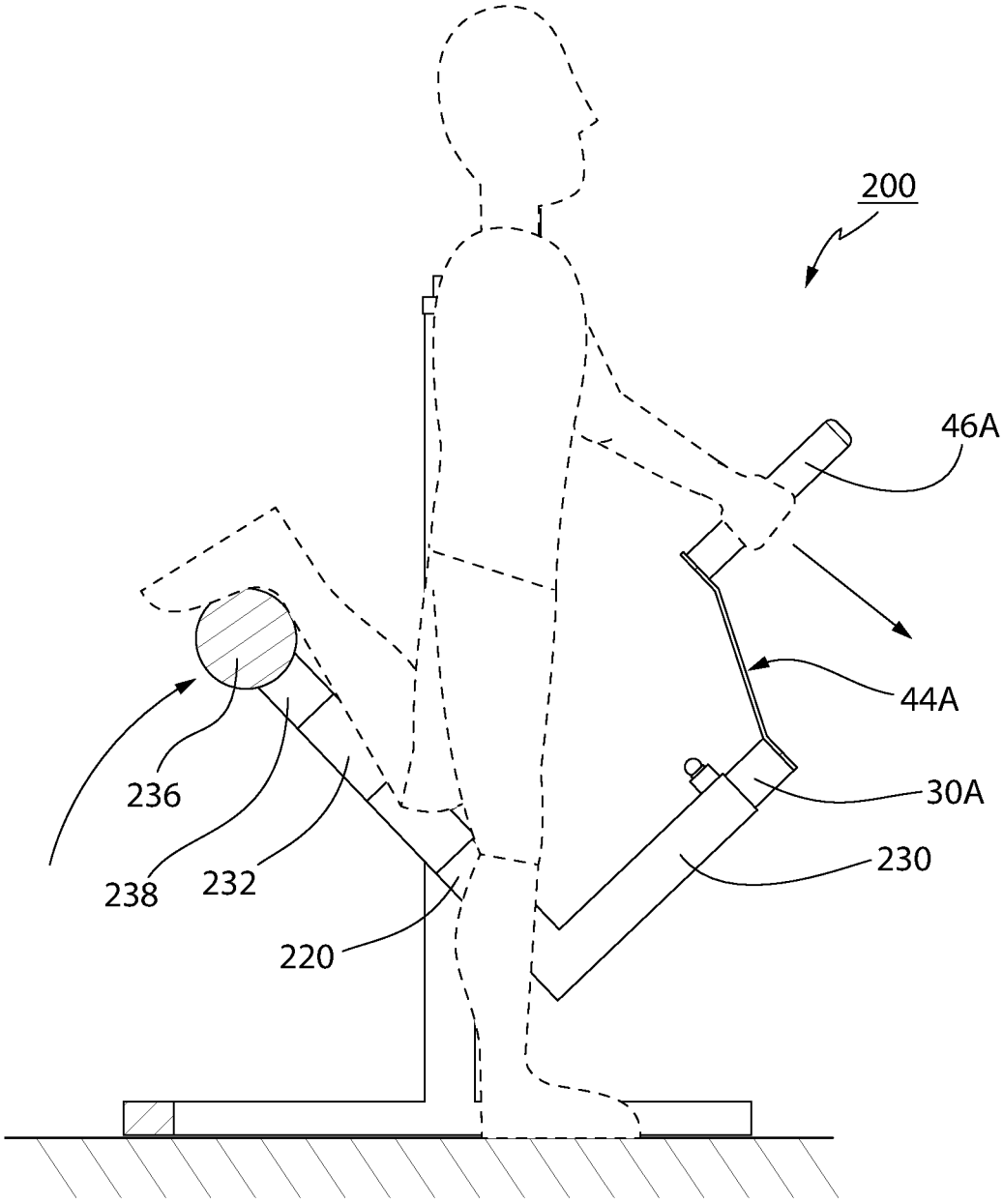
FIG. 14B is a side sectional view similar to FIG. 14A showing the quadriceps of the shorter individual's leg being stretched.

Referring to FIGS. 13A and 13B, the device 200 is shown in use by an individual taller than the individual depicted in FIGS. 14A and 14B. Prior to commencing the stretching operation the rotational mount 22A is adjusted to position the rotational axis of the stretching member 222 in vertical alignment with the individual's knee. As can be seen, the rotational mount 22A is shown in a position near the top of the elongate slots 216 in the frame member 214 due to the height of the individual; or more specifically due to the height of the individual's knee from the floor or other supporting structure.

It also is desirable to adjust the distance between the vertical mount 22A and the foot support 236 to support the exerciser's foot adjacent the upper end thereof. This adjustment is achieved by adjusting the telescopic position of mounting segment 238 in the hollow arm member 228 of the stretching member 222. It should be noted that such an adjustment is not required in the hamstring stretching device 10 because the individual conduction the exercise can move closer to, or farther from the foot support 28, depending on the individual's height. However, when stretching the quadriceps, the individual's knee desirably should be substantially in axial alignment with the rotational axis of the stretching member 222; thereby requiring adjustment of the first section 228 of the stretching member to accommodate differences in length between individuals' knees and the top of their foot. For each individual, this is a shorter distance, or length, than the vertical distance required between the rotational axis of the rotational mount 22A and the support surface on which the individual is standing; due to the fact that this latter vertical distance is measured from the bottom of the individual's foot engaging the support surface, whereas the linear distance between the rotational mount 22A and foot support 236 generally is the length of the individual's leg between the upper part of the foot and the knee.

As discussed earlier, the gripping member 44A also preferably is adjustable to permit an exerciser to set a comfortable handle-gripping position, which is dictated, at least in part, by the individual's height. However, in accordance with the broadest aspects of this invention such adjustability of the gripping member 44A may not be employed.

As shown in FIG. 13A, an individual, prior to carrying out the stretching operation, positions the stretching member 222 in a desired vertical position to permit the leg to be stretched to be bent comfortably both upwardly and rearward to rest on the foot support 236, as illustrated. This positioning step is achieved by the user gripping the handle 264 to compress momentary switch 50A for disengaging the clutch mechanism 100A, and then rotating the stretching member 222 to a position at which the foot support 236 is sufficiently low, or close to the ground, to permit the exerciser to easily place his/her foot on the foot support. Thereafter, when the handle is released the clutch mechanism 100A will return to its normal position for preventing rotation of the stretching member 222, until desired.

In addition, gripping member 44A is adjusted through the cooperating pin 254 and apertures 250 described earlier, to permit an individual to comfortably operate the stretching device 200 through the handle 46A.

FIG. 13A only is intended as a representative starting position, it being understood that the foot support 236 can be located either in a higher or lower starting position, as desired. This higher or lower position can be established by adjusting both the vertical position of the rotational mount 22A relative to the floor or other supporting surface and the rotational position of the stretching member 222 about the rotational axle 218.

FIG. 13B, shows the individual in FIG. 13A carrying out a quadriceps stretching operation by pushing handle 46A in the direction of the indicated arrow to cause upper, arcuate movement of the foot support 236 and the foot resting thereon to thereby move the lower leg (the region of the leg below the knee) toward the exerciser's buttocks to stretch the quadriceps.

During the stretching operation the individual can support himself/herself to provide balance by engaging the rail or support 68A with the hand opposed to the one employed to grip the handle 46A to release the clutch 100A and rotate the stretching member 222.

It should be noted that the stretching operation is controlled and carried out manually by the exerciser moving the stretching member 222 through its handle 46A. This is a very desirable feature of this invention, and eliminates the need for the exerciser to place the leg to be stretched on a stationary support or mount as in prior art devices, and then bend, or lower his/her body relative to the supported leg by bending the other leg. This latter arrangement can create a lack of balance, and also may be difficult to employ if the individual's knee required to support him/her in a bent position is weak.

Referring to FIGS. 14A and 14B, use of the device 200 by an individual shorter than the individual illustrated in FIGS. 13A and 13B is shown. In preparation for carrying out the stretching operation the rotational member 22A is positioned, or adjusted within the aligned axial slots 216 of the frame member 214 so that its rotational axis is located substantially in alignment with the exerciser's knee. Likewise, the length of the first section 232 of the stretching member 222 is adjusted so that it is of a proper length for supporting the exerciser's leg adjacent the top of the foot thereof. In addition, the gripping member 44A of the stretching member 222 is adjusted to position handle 46A into a position that is comfortable for the exerciser to grip and carry out the quadriceps stretching operation.

Initially, the exerciser grips the handle 46A to engage switch 50A to disengage the clutch 100A and then rotate the stretching member 222 into a position in which the foot support 236 is sufficiently low to permit an exerciser to comfortably place his/her foot, or a region adjacent his/her foot, on the foot support 236. Thereafter, the handle 46A is disengaged; thereby preventing the stretching member 222 from rotating while the individual places his leg on the foot support 236.

Referring to FIG. 14B, the exerciser then grips the handle 46A to close switch 50A to release the clutch 100A and then moves the handle in the direction indicated by the arrow to cause the individual's leg to be rotated toward the buttocks in an arcuate path about the rotational axis of the stretching member 222, as indicated by the arcuate arrow in FIG. 14B. The individual carrying out the exercise can engage or support the hand that is not operating the stretching member on the supporting rail 68A to provide support for the individual while carrying out the stretching operation.

It should be noted that different systems are shown for adjusting the vertical height of the rotational member 22 of the device 10, on the one hand, and the rotational member 22A of the device 200, on the other hand. However, in accordance with the broadest aspects of this invention the system employed for adjusting the vertical height of the rotational member 22 of the device 10 can be employed in the device 200, and vice versa. That is, either an arcuate adjustment system, such as the one disclosed in device 10, or a purely linearly adjustable system such as is disclosed in device 200, can be used in either the device 10 or the device 200.

Applicant has determined that the distance of vertical adjustability required for the quadriceps stretching device 200 to accommodate individuals of different heights will be less than the distance of vertical adjustability desired for the hamstring stretching device 10. Applicant believes that the screw adjustability system employed in the quadriceps stretching device 200 may be more difficult to use in providing the degree of vertical adjustability desired in the hamstring muscle stretching device 10. However, the screw adjustability system is considered to be sufficiently easy to use over the required vertical adjustability range in the quadriceps stretching device 200.

In particular, applicant has measured the vertical length between the bottom of the foot to the knee of 8 individual's ranging in height from about 4' 11" to about 6' 5." For those individual's the vertical length between the bottom of the foot to the knee ranged from about 20 inches to 28 inches, respectively. Thus, approximately 8-10 inches of vertical adjustability is all that is believed to be required in the device 200 for stretching the quadriceps of virtually all individuals. Thus, providing the elongate slots 216 of a length between 8 inches and 10 inches; the lower end of which is approximate 20 inches above the surface supporting the exerciser should accommodate virtually all individuals desiring to use the device 200. Of course, the length and/or starting location of the slots 216, as well as the length of the frame member 214 and inner sleeve 270 can be varied, as necessary, to accommodate individuals that are taller than 6' 5 inches or shorter than 4'11. For example, such modifications could be made to a quadriceps stretching device intended to accommodate taller individuals, such as basketball players, that may be taller than 7 feet or even taller than 7.5 feet. For example, devices specifically configured for use by very tall individuals can be configured to accommodate individuals ranging in height from about 5' 5" to 8'; thereby still not requiring more than 8-10 inches of adjustability to locate the pivot axis in alignment with the individuals' knees. The screw adjustment system preferably employed in device 200 has the advantage over the rotating arm adjustment system employed in the device 10, in that it does not require a separate clutch mechanism similar to clutch mechanism 54 employed in the device 10.

Various modifications within the scope of the invention can be made to the devices 10 and 200.

For example, and not by way of limitation, in accordance with broad aspects of this invention, the system for adjusting the vertical height of the rotational axis of the stretching members in both the hamstring stretching device 10 and the quadriceps stretching device 200 can be of any desired construction, and in addition, does not necessarily need to be manually operable. However, a manually operated system for varying the vertical height of the rotational axis of the stretching members in both the hamstring muscle stretching device 10 and the quadriceps stretching device 200 is most preferred.

Moreover, for simpler operation, as may be required when stretching devices 10, 200 are intended to be used by senior citizens, vertical adjustability of the rotational axis of the stretching member 22, 22A in the devices 10 and 200, respectively, may be omitted. However, omitting such a vertically adjustable feature does compromise the most desired operation of the devices.

In addition, the particular clutch mechanism employed to prevent and permit rotation of the stretching members about their rotational axles can be of any desired type; e.g., electromechanical, pneumatic, manual, etc. However, regardless of the type of clutch mechanism that is employed, it is most preferred that the clutch mechanism be actuatable from the handle of the device, e.g., through a switch or similar engagement member, such as a lever attached to the handle.

The stretching members 18, 222 in accordance with broad aspects of this invention can be of any desired construction, provided the construction includes sections on opposite sides of a rotational axle, a foot support or surface for supporting the foot of a leg to be stretched, and a gripping member to be engaged for rotating the stretching members. For example, a unitary L-shaped member need not be employed in the construction of either of the stretching members 18, 222, although in the preferred construction such an arrangement is a desirable feature. In addition, the gripping members can be of any desired configuration, and can actually be a distal segment or region of the section of the stretching member on the side of the rotational axis opposite the side including the foot support. In addition, the foot support can be of any desired configuration or shape just so it is capable of supporting a user's leg adjacent the foot thereof.

Moreover, the first section 27 of stretching members 18, which includes the foot support 28 thereon, can be made adjustable to permit its length to be varied, if desired, e.g., in the same or similar manner as first section 232 of stretching member 222 is adjustable through the inclusion of mounting segment 238 therein. Other arrangements for providing adjustability of the first section 27 can be employed, if desired. However, in accordance with the preferred embodiment of this invention an adjustable first section 27 is not believed to be necessary in the stretching device 10.

Moreover, the second sections 29, 234 of the stretching members 22, 222, respectively, can include linearly adjustable segments to permit the length of the second sections to be varied, e.g., by the inclusion of telescoping segments to provide the second sections. However, in accordance with the most preferred embodiments of this invention such linear adjustability is not considered to be necessary.

The frame assemblies of the devices 10 and 200 can be of any desired configuration, and in accordance with broad aspects of this invention a support arm or rail for the hand/arm that is not being employed to operate the stretching member of the device may be omitted. However, such a support arm or rail is a very desirable feature in the most preferred embodiments of this invention.

While the invention has been described in detail and with reference to specific examples thereof, it will be apparent to one skilled in the art that various changes and modifications can be made therein without departing from the spirit and scope thereof.

What is claimed is:

1. A device for stretching either the quadriceps or hamstring muscles of an individual's legs while the individual is in a standing position, said device including:

a frame assembly;

a rotational mount connected to said frame assembly, a stretching member rotationally mounted on said rotational mount, intermediate ends of said stretching member to provide a first section extending on one side of the rotational mount and a second section extending on a second side of the rotational mount opposite said first side, said stretching member including a foot support adjacent a distal end of the first section spaced from the rotational mount and a gripping member adjacent the second section spaced from the rotational mount, said stretching member being configured so that the length of the first section remain the same during the stretching of either the quadriceps or hamstring muscles, whereby said foot support moves in an arcuate path about said rotational mount during the stretching of either the quadriceps or hamstring muscles;

said gripping member being configured to be gripped by a hand of an individual desiring to apply a rotational force to the stretching member about the rotational mount when said individual is in a standing position and with a foot of the individual being on said foot support, whereby said individual can apply a manual, rotational force to the stretching member through the gripping member to thereby cause arcuate movement of the foot support to stretch either the quadriceps or hamstring muscles of the individual's legs depending upon whether the individual's back or front is facing the foot support, respectively.

2. The device of claim 1, wherein said rotational mount is vertically adjustable relative to a surface on which said individual is standing.

3. The device of claim 2, wherein said rotational mount is vertically adjustable in a linear direction.

4. The device of claim 2, wherein said rotational mount is vertically adjustable through an arcuate path including a vertical component of motion.

5. The device of claim 1, wherein said rotational mount is connected to a member movable on said frame assembly to provide vertical movement of said rotational mount relative to a surface on which said individual is standing.

6. The device of claim 1 wherein said rotational mount is connected to a member movable on said frame assembly in a linear, vertical direction to provide vertical movement of said rotational mount relative to a surface on which said individual is standing.

7. The device of claim 1 wherein said rotational mount is connected to a member movable on said frame assembly in an arcuate path including a vertical component of movement of said rotational mount relative to a surface on which said individual is standing.

8. The device of claim 1, said foot support being configured to receive and support either foot of the individual to stretch the quadriceps of either leg when the individual's back is facing the foot support and to stretch the individual's hamstring muscles of either leg when the individual is facing the foot support.

9. The device of claim 1, said frame assembly including a hand support configured to be engaged by the individual's hand that is not employed to grip the gripping member when the individual is using the device, said hand support being laterally spaced from the stretching member to provide a space between said hand support and stretching member to accommodate the individual in a region between said hand support and stretching member.

10. The device of claim 9, said foot support being configured to receive and support either foot of the individual to stretch the quadriceps of each of the individual's legs when said individual is standing in a region of the space between said hand support and the stretching member with said individual's back to said foot support and either leg of said individual being bent rearward about a knee of the leg to be stretched and with the bent leg being positioned on the foot support adjacent a foot of said bent leg to be stretched, or to stretch the hamstring muscles of each of the individual's legs when the individual is standing in the region of the space between said hand support and the stretching member with said individual facing said foot support and either leg of said individual being substantially straight and being positioned on the foot support adjacent a foot of the leg to be stretched.

11. The device of claim 1, further including a clutch normally engaged for preventing rotation of the stretching member about said rotational mount, said clutch including a manually actuatable member for disengaging said clutch to permit manual rotation of the stretching member about the rotational mount for stretching either the quadriceps or hamstring muscles of the individual.

12. The device of claim 1, said gripping member of said stretching member being mounted for linear movement to permit adjustment of the gripping location by the individual.

13. The device of claim 1 for stretching the quadriceps of an individual, said rotational mount being vertically adjustable relative to a surface on which said individual is standing to permit aligning the axis of rotation of the vertical mount with a knee of the individual's leg to be stretched when said individual is standing on said surface, said first section of said stretching member including linearly adjustable segments for adjusting the length of the first section to permit the foot support to engage a lower section of the leg of the individual adjacent said individual's foot when said individual's leg is bent upwardly and rearward about said individual's knee with the individual facing away from said foot support, said gripping member of said stretching member being configured to be manually engaged by the individual to move the stretching member about the rotational mount in an arcuate path for moving the section of the individual's leg below the knee toward the individual's buttocks for stretching the quadriceps of the individual's leg.

14. The device of claim 13, said foot support being configured to receive and support either foot of the individual to stretch the quadriceps of each of the individual's legs with said individual being positioned in substantially the same region.

15. The device of claim 13, said frame assembly further including a hand support configured to be engaged by the individual's hand that is not employed to grip the gripping member when the individual is employing the device, said hand support being laterally spaced from the stretching member to provide a space between said hand support and stretching member to accommodate the individual in a region between said hand support and stretching member during a stretching operation.

16. The device of claim 13, said gripping member being mounted for linear movement to permit adjustment of the gripping member to be engaged by an individual engaged in stretching the quadriceps.

17. The device of claim 1 for stretching the hamstring muscles of the individual's legs, said rotational mount being vertically adjustable relative to a surface on which said individual is standing to permit adjustment of a the vertical location of the foot support relative to a surface on which said individual is standing for providing a comfortable orientation of the individual's leg prior to commencing stretching the hamstring muscles, stretching of said hamstring muscles being achieved by rotation of said foot support in an upward, arcuate path about the rotational mount by the individual manually rotating the stretching member with the individual facing the foot support and with a leg of the individual in a substantially straight condition engaging said foot support adjacent a foot of said leg.

18. The device of claim 17, said foot support being configured to receive and support either foot of the individual to stretch the hamstring muscles of each of the individual's legs.

19. The device of claim 17, said frame further including a hand support configured to be engaged by the individual's hand that is not employed to grip the gripping member when the individual is employing the device, that hand support being laterally spaced from the stretching member to provide a space between said hand support and stretching member to accommodate the individual in a region between said hand support and stretching member during a stretching operation.

20. The device of claim 17 for stretching the hamstring muscles of the individual's legs, said first section of the stretching member being of a fixed, non-adjustable length.

21. A device for stretching either the quadriceps or hamstring muscles of an individual's legs while the individual is in a standing position, said device including:

a frame assembly;

a rotational mount connected to said frame assembly;

a stretching member rotationally mounted on said rotational mount, intermediate ends of said stretching member to provide a first section extending on one side of the rotational mount and a second section extending on a second side of the rotational mount opposite said first side, said stretching member including a foot support adjacent a distal end of the first section spaced from the rotational mount and a gripping member adjacent the second section spaced from the rotational mount;

said gripping member being configured to be gripped by a hand of an individual desiring to apply a rotational force to the stretching member about the rotational mount when said individual is in a standing position and with a foot of the individual being on said foot support, whereby said individual can apply a manual, rotational force to the stretching member through the gripping member to thereby stretch either the quadriceps or hamstring muscles of the individual's legs depending upon whether the individual's back or front is facing the foot support, respectively; and said frame assembly including a hand support configured to be engaged by the individual's hand that is not employed to grip the gripping member when the individual is using the device, said hand support being laterally spaced from the stretching member to provide a space between said hand support and stretching member to accommodate the individual in a region between said hand support and stretching member, said hand support being in a fixed position during movement of the gripping member to rotate the stretching member and stretch either the quadriceps or hamstring muscles of the individual's legs depending upon whether the individual's back or front is facing the foot support, respectively.

22. The device of claim 21, said hand support being an elongate member.

23. The device of claim 21, said stretching member being configured so that the length of the first section remains the same during the stretching of either the quadriceps or hamstring muscles, whereby said foot support moves in an arcuate path about said rotational mount during the stretching of either the quadriceps or hamstring muscles.

24. The device of claim 21, wherein said rotational mount is connected to a member movable on said frame assembly to provide vertical movement of said rotational mount relative to a surface on which said individual is standing.

* * * * *